US009080361B2

(12) United States Patent
Nykilchuk

(10) Patent No.: US 9,080,361 B2
(45) Date of Patent: Jul. 14, 2015

(54) OVERHEAD DOOR BACKUP SPRING SYSTEM

(71) Applicant: Kydrid Door Systems, Inc., Calgary (CA)

(72) Inventor: Trever Nykilchuk, Calgary, CA (US)

(73) Assignee: Kydrid Door Systems Inc., Calgary (CA)

( * ) Notice: Subject to any disclaimer, the term of this patent is extended or adjusted under 35 U.S.C. 154(b) by 0 days.

(21) Appl. No.: 14/333,070

(22) Filed: Jul. 16, 2014

(65) Prior Publication Data

US 2015/0020456 A1 Jan. 22, 2015

Related U.S. Application Data

(60) Provisional application No. 61/847,653, filed on Jul. 18, 2013.

(51) Int. Cl.
*E05F 11/00* (2006.01)
*E05D 13/00* (2006.01)

(52) U.S. Cl.
CPC ..... *E05D 13/1215* (2013.01); *E05D 13/1261* (2013.01); *E05D 13/1269* (2013.01)

(58) Field of Classification Search
CPC ..... E05D 13/00; E05D 15/38; E05D 15/56; E05D 13/1261; E05D 13/1269; E05F 3/00; E06B 3/00
USPC ..... 49/197, 199, 322, 506; 160/191, 189, 160/192
See application file for complete search history.

(56) References Cited

U.S. PATENT DOCUMENTS

| | | | | |
|---|---|---|---|---|
| 1,724,995 | A | 8/1929 | Dautrick | |
| 2,059,833 | A | 11/1936 | Wind | |
| 3,559,716 | A | 2/1971 | Loucks | |
| 4,385,471 | A | 5/1983 | Gabry et al. | |
| 5,566,740 | A | 10/1996 | Mullet et al. | |
| 5,638,640 | A * | 6/1997 | Harbeck et al. | 49/322 |
| 6,012,201 | A | 1/2000 | Mitts et al. | |
| 6,134,835 | A * | 10/2000 | Krupke et al. | 49/200 |
| 6,401,793 | B1 | 6/2002 | Martin | |
| 6,742,564 | B2 | 6/2004 | Martin | |
| 7,325,584 | B2 * | 2/2008 | Bousson | 160/315 |
| 8,162,026 | B1 | 4/2012 | Lundahl | |
| 2007/0056694 | A1 | 3/2007 | Mullet | |

FOREIGN PATENT DOCUMENTS

| | | | |
|---|---|---|---|
| JP | 5248158 | A | 9/1993 |
| JP | 960448 | A | 3/1997 |
| JP | 9275865 | A | 10/1997 |

* cited by examiner

*Primary Examiner* — Jerry Redman
(74) *Attorney, Agent, or Firm* — David A. Guerra

(57) ABSTRACT

The present invention essentially comprises an overhead door backup spring system for providing an auxiliary spring counterweight to operate an overhead door shaft upon failure of a spring. The system has an activation unit, a control assembly, an engagement assembly operably associated with the activation unit, and an auxiliary spring engagement assembly operably associated with the control and engagement assemblies. The control assembly has an engagement block engageable with a spring post of the auxiliary spring assembly. The engagement assembly has an engagement post engageable with the spring post to transfer torque from the auxiliary spring to the overhead door shaft. An engaged position has the engagement post not engaged with the spring posts while the engagement block is engaged with the spring post. A non-engaged position has the engagement post engaged with the spring post, and the engagement block not engaged with the spring post.

18 Claims, 19 Drawing Sheets

OVERHEAD DOOR BACKUP SPRING SYSTEM

CROSS-REFERENCE TO RELATED APPLICATION

This application is a U.S. non-provisional utility application under 35 U.S.C. §111(a) based upon U.S. provisional application 61/847,653 filed on Jul. 18, 2013. Additionally, this U.S. non-provisional utility application claims the benefit of priority of U.S. provisional application 61/847,653 filed on Jul. 18, 2013. The entire disclosure of the prior application is incorporated herein by reference.

BACKGROUND OF THE INVENTION

1. Field of the Invention

The present invention relates to an overhead door backup spring system for use in connection with providing an emergency spring counterweight for overhead doors upon failure of a main spring counterweight.

2. Description of the Prior Art

Overhead door backup spring systems are desirable for allowing a user to still operate an overhead door, such as a garage door, even when the main spring counterweight has failed. The majority of overhead doors include multiple door panel sections that are hinged together and which travel along parallel side tracks or rails from a closed vertical position to an open horizontal position. These overhead doors normal utilize a torsion spring connected to a shaft which supplies the force to counter balance the door during the opening operation. The spring has a life cycle and will break or fail when reached.

When the spring fails, the user will call a garage door technician to make a house-call to replace the broken spring. Many users are not able to manually lift the full weight of the garage door because the spring is not providing the counter lifting force. In some cases, the user's vehicle is in the garage, which is now trapped and thus the technician would be required to make an emergency house-call. The emergency house-call can cost the user an increased rate over planned service calls.

Known garage door auxiliary spring systems specifically use a second spring that is connected to the shaft and which provides a lifting force for the door during only a portion of the travel path.

While the above-described devices fulfill their respective, particular objectives and requirements, the aforementioned patents do not describe an overhead door backup spring system that allows providing an emergency spring counterweight for overhead doors upon failure of a main spring counterweight Therefore, a need exists for a new and improved overhead door spring system that uses an extra spring providing an emergency spring counterweight for overhead doors upon failure of a main spring counterweight. In this regard, the present invention substantially fulfills this need. In this respect, the overhead door backup spring system according to the present invention substantially departs from the conventional concepts and designs of the prior art, and in doing so provides an apparatus primarily developed for the purpose of providing an emergency spring counterweight for overhead doors upon failure of a main spring counterweight.

SUMMARY OF THE INVENTION

In view of the foregoing disadvantages inherent in the known types of garage door auxiliary spring systems now present in the prior art, the present invention provides an improved overhead door backup spring system, and overcomes the above-mentioned disadvantages and drawbacks of the prior art. As such, the general purpose of the present invention, which will be described subsequently in greater detail, is to provide a new and improved overhead door backup spring system and method which has all the advantages of the prior art mentioned heretofore and many novel features that result in an overhead door backup spring system which is not anticipated, rendered obvious, suggested, or even implied by the prior art, either alone or in any combination thereof.

To attain this, the present invention essentially comprises an overhead door backup spring system having a spring associated with a shaft of an overhead door assembly, an activation unit, a control assembly operably, an auxiliary spring engagement assembly, and an engagement assembly. The control assembly has a moveable engagement block. The auxiliary spring engagement assembly having an extension associated with an end of an auxiliary spring, and at least one spring post extending from the extension. The spring post is operably associated with the engagement block. The engagement assembly is operably associated with the activation unit and the auxiliary spring engagement assembly. The engagement assembly has at least one engagement post slidably associated with the shaft. The engagement post is engageable with the spring post. The engagement post is in non-engagement with the spring post, and the engagement block is engaged with the spring post in a non-engaged position. The engagement post is engaged with the spring post, and the engagement block being in non-engagement with the spring post in an engaged position. The engagement assembly is configured to transfer torque from the auxiliary spring to the shaft in the engaged position.

The activation unit can include a plunger slidably associated with the shaft, and a plunger spring biasing the plunger toward the engagement assembly. The activation unit can further include a plunger sleeve surrounding the plunger and the plunger spring. The plunger sleeve can define a slot configured to slidably receive a plunger pin extending from the plunger and limit movement of the plunger.

There has thus been outlined, rather broadly, the more important features of the invention in order that the detailed description thereof that follows may be better understood and in order that the present contribution to the art may be better appreciated.

The engagement assembly may also include an engagement disk slidably associated with the shaft and engageable with the plunger. The engagement post extends from the engagement disk parallel to the shaft.

The engagement assembly can further include a pillow block attachable to the shaft. The pillow block defines at least one longitudinal bore therethrough configured to slidably receive the engagement post therethrough.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved overhead door backup spring system that has all of the advantages of the prior art garage door auxiliary spring systems and none of the disadvantages.

It is another object of the present invention to provide a new and improved overhead door backup spring system that may be easily and efficiently manufactured and marketed.

An even further object of the present invention is to provide a new and improved overhead door backup spring system that has a low cost of manufacture with regard to both materials and labor, and which accordingly is then susceptible of low prices of sale to the consuming public, thereby making such overhead door backup spring system economically available to the buying public.

Still another object of the present invention is to provide a new overhead door backup spring system that provides in the apparatuses and methods of the prior art some of the advantages thereof, while simultaneously overcoming some of the disadvantages normally associated therewith.

Even still another object of the present invention is to provide an overhead door backup spring system for providing an emergency spring counterweight for overhead doors upon failure of a main spring counterweight. This eliminates broken spring emergency calls by a technician and allows use of the door until the main spring is repaired or replaced.

Lastly, it is an object of the present invention to provide a new and improved method of providing an auxiliary spring counterweight to an overhead door using an overhead door backup spring system. The method can include the steps of coupling a spring with a shaft of an overhead door. The spring is configured to provide a counterweight force to the overhead door via the shaft. Then coupling an activation unit and a control assembly with the spring. Upon failure of the spring, sliding the activation unit and activating the control assembly from a non-engaged position to an engaged position. Then moving an engagement block of the control assembly out of engagement with at least one spring post extending from an auxiliary spring. Simultaneously with moving an engagement assembly by the activation unit to engage at least one engagement post with the spring post. Then transferring torque from the auxiliary spring to the shaft via the engagement assembly.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
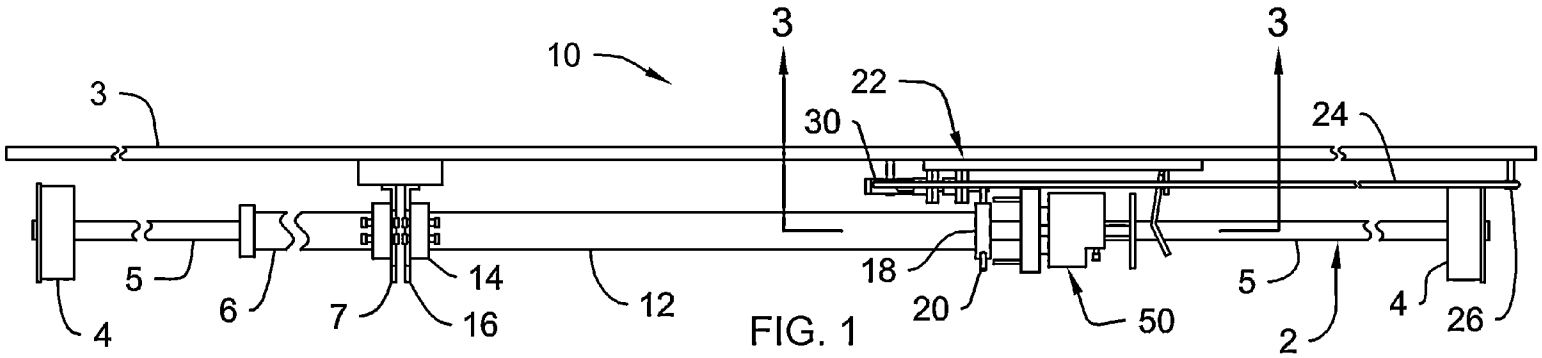
FIG. 1 is a top elevational view of an embodiment of the overhead door backup spring system constructed in accordance with the principles of the present invention and fitting to an existing overhead door spring and shaft assembly, with the phantom lines depicting environmental structure and forming no part of the claimed invention.

Referring now to the drawings, and particularly to FIGS. 1-26, an embodiment of the overhead door backup spring system of the present invention is shown and generally designated by the reference numeral 10.

Figure 2:
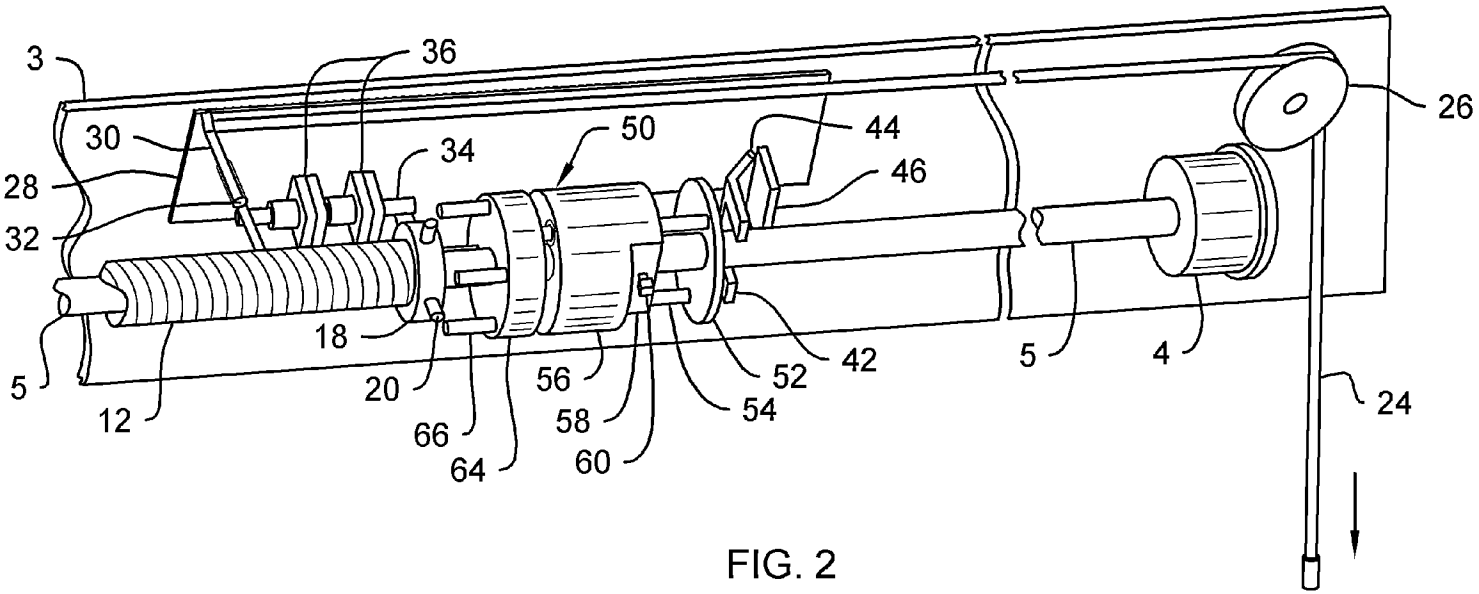
FIG. 2 is a top perspective view of the overhead door backup spring system of the present invention.

In FIGS. 1 and 2, a new and improved overhead door backup spring system 10 of the present invention for providing an emergency spring counterweight for overhead doors upon failure of a main spring counterweight is illustrated and will be described. More particularly, the backup spring system 10 can be retrofitted to an existing overhead door spring and shaft assembly 2. It can be appreciated that the present invention can be integrated in new overhead door spring and shaft assemblies. Standard overhead door spring and shaft assemblies 2 are secured to a wall or beam 3, and include a shaft 5 connected to bearings 4 at its ends, and a main spring 6 connected to the shaft 5 and a main spring bracket 7. The main spring 6 provides torque to the shaft 5 which provides a lifting force to an overhead door (not shown).

When the main spring 6 fails, the door is always in the closed position and/or will remain in the closed position. The user would be required to manually lift the entire weight of the door, and in cases where the user is not able to lift the door and the user's vehicle in the garage, then the user would require an emergency service call from a technician. The emergency service call can be very expensive, even double a standard service call rate.

The backup spring system 10 includes an auxiliary spring 12, a control assembly 22 and an engagement assembly 50. The auxiliary spring 12 is held in a coiled state by the control assembly 22, thereby storing potential energy or torque and releasing such upon activation of a line 24 by the user. The control assembly 22 simultaneously releases the torque energy of the auxiliary spring 12 and transfers it to the engagement assembly 50, which then transfer it to the shaft 5.

The auxiliary spring 12, can be but not limited to, a coil spring fitted over the shaft 5 so that the shaft is received in the auxiliary spring 12. The auxiliary spring 12 is attached to a mounting bracket 16 via a coupler 14 at a first end, which secures the first end of the auxiliary spring 12 to the mounting bracket 16 and prevents the auxiliary spring 12 from rotating. A second end of the auxiliary spring 12 includes a fitting 18 having a plurality of extensions or spring posts 20 extending radially outwardly therefrom. The second end of the auxiliary spring 12 and fitting 18 are configured to be rotatable about the shaft 5.

Regarding FIGS. 2-6 the control assembly 22 can be fitted to a mount 28 which is attached to the beam 3 or can be attached directly to the beam 3. The line 24 activates the control assembly 22 and can run over a pulley 26, thereby allowing the line 24 to be positioned remote from the control assembly 22. The control assembly 22 includes a lever 30 pivotably mounted to the mount 28 via a pivot pin or hinge 32.

Figure 3:
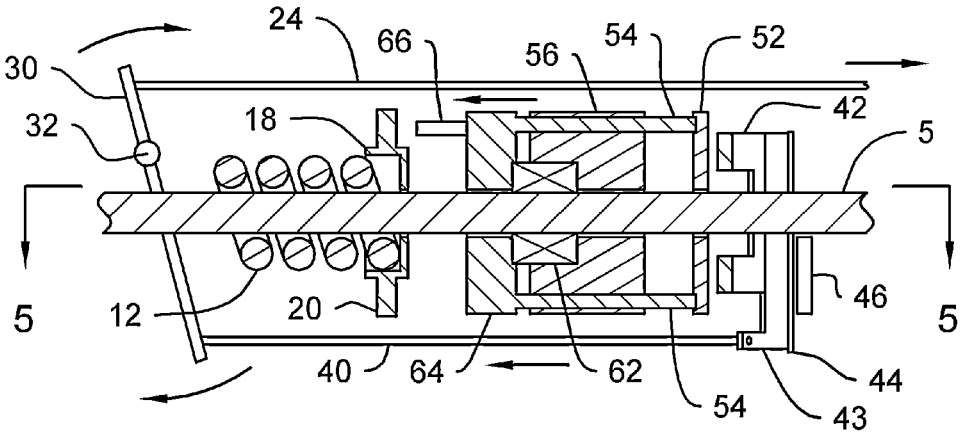
FIG. 3 is a cross-section view of the activation linkage and the backup spring engaging assembly of the overhead door backup spring system in the non-engaged position taken along line 3-3 of FIG. 1.
Figure 4:
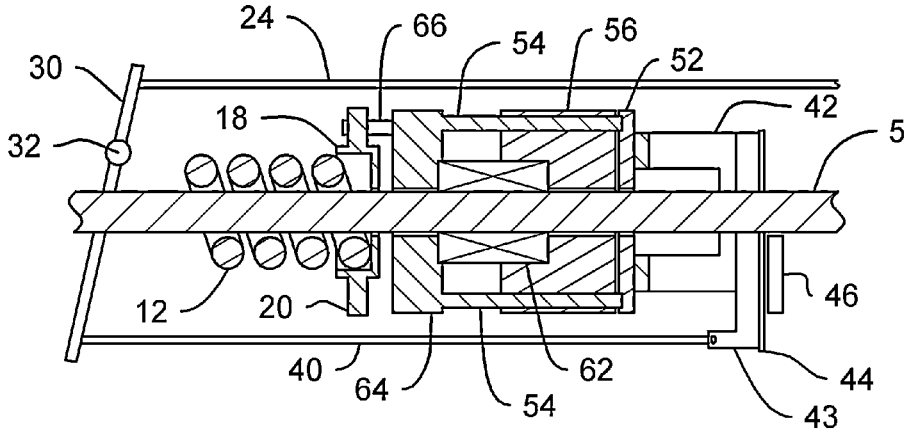
FIG. 4 is a cross-section view of the activation linkage and the backup spring engaging assembly of the overhead door backup spring system in the engaged position.

The hinge 32 is located between free ends of the lever 30, with the line 24 coupled at one end and an engagement rod 40 coupled to an opposite end, as best illustrated in FIGS. 3 and 4. A retaining rod 34 is coupled to the lever 30 between the hinge 32 and the engagement rod 40. The retaining rod 34 passes through at least two linear bearings 36 fitted to the mount 28. The linear bearings 36 hold the torque of the auxiliary spring 12 in a pre-wound state, thus creating the potential energy or torque required to rotate the shaft 5 upon activation. The retaining rod 34 extends out past the linear bearings 36 so as to protrude between the spring posts 20 and thus engage with one of the spring posts 20 to hold the auxiliary spring 12 in the pre-wound state.

The control assembly 22 additionally includes a fork 42 that is pivotably coupled to the mount 28 via a fork hinge 44, and is configured so that the shaft 5 passes between forks thereof. A fork stop 46 extends away from the mount 28 adjacent the fork 42 so as to limit the travel of the fork 42 away from the engagement assembly 50. The engagement rod 40 is additionally coupled to a fork extension 43 spaced away from and connected to the fork 42. The engagement rod 40 transfers rotational movement of the lever 30 to pivotal movement of the fork 42.

The engagement assembly 50 features a central bore configured to receive the shaft 5 therethrough, and includes a disk 52, a pillow block 56 and an engagement disk 64. The disk 52 and engagement disk 64 are slidable on the shaft 5, and at least two sliding rods 54. The disk 52 includes a surface configured to contact the fork 42. The sliding rods 54 extend away from the disk 52, through the pillow block 56 by traveling on a bearing race, and are coupled to the engagement disk 64.

The pillow block 56 features a cutout 58 that has a threaded bore therethrough for receiving a set screw 60. The set screw 60 is configured to engage with the shaft 5 and retain the pillow block 56 to the shaft 5 while preventing the pillow block 56 to rotate about the shaft 5. The pillow block 56 additionally includes a linear bearing 62 fitted to a recess in the pillow block 56 and to the engagement disk 64, and is configured to slide on the shaft 5.

The engagement disk 64 includes a plurality of engagement posts 66 extending away from the engagement disk 64 toward the fitting 18, wherein the engagement posts 66 are parallel with the shaft 5. The engagement posts 66 are configured to engage with the spring posts 20, upon movement of the disk 52 produced by the fork 42.

Figure 5:
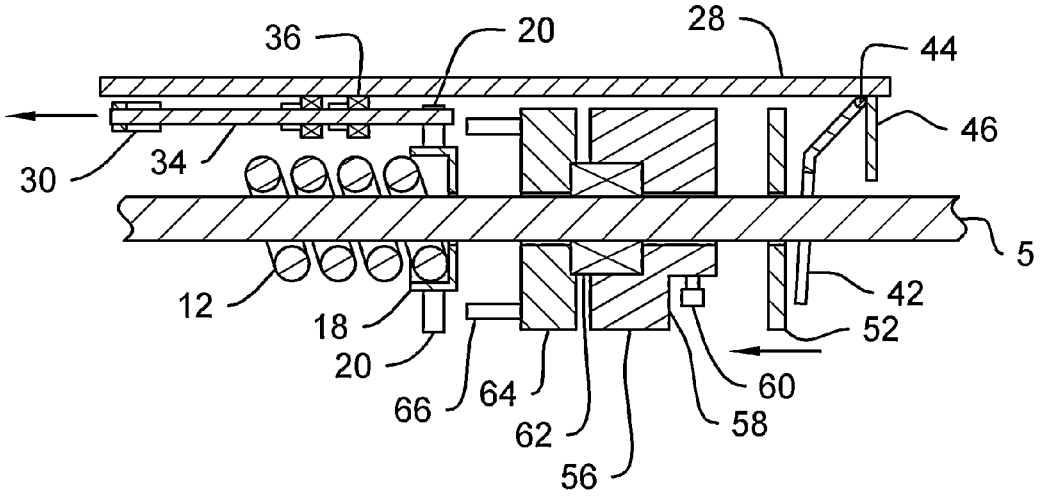
FIG. 5 is a cross-section view of the activation linkage and the backup spring engaging assembly of the overhead door backup spring system in the non-engaged position taken along line 5-5 of FIG. 3.

Regarding FIGS. 3 and 5, the lever 30, fork 42, disk 52 and engagement disk 64 are in a non-engaged position. In the non-engaged position, the retaining rod 34 is between the spring posts 20 and in contact with at least one of the spring posts 20. The fork 42 is not engaged with the disk 52, so the disk 52 and the engagement disk 64 are positioned away from the auxiliary spring 12, thus the engagement posts 66 are not located between the spring posts 20. The linear bearings 36 hold the retaining rod 34 in place, preventing the retaining rod 34 from moving upward or downward by the resulting torque from the pre-wound auxiliary spring 12.

Figure 6:
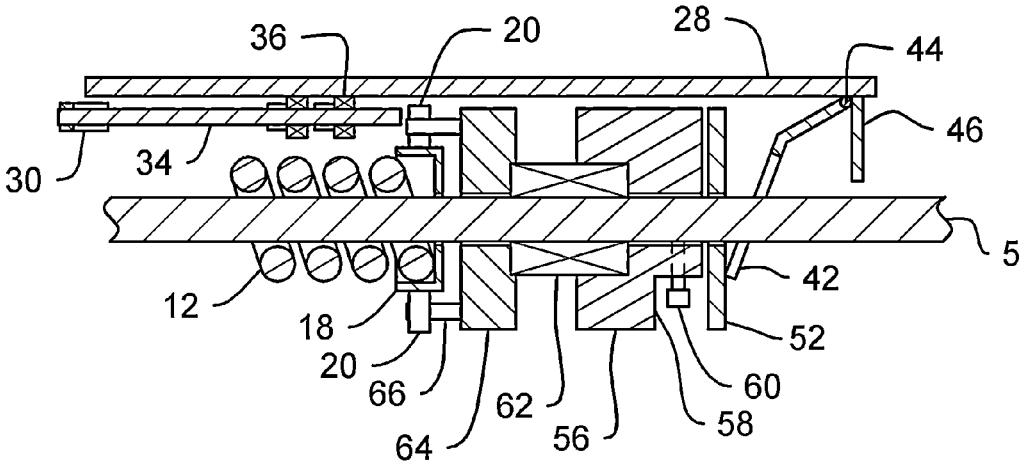
FIG. 6 is a cross-section view of the activation linkage and the backup spring engaging assembly of the overhead door backup spring system in the engaged position.

Regarding FIGS. 4 and 6, the user would pull on the line 24, thereby pivoting the lever 30 about the hinge 32 and thus pulling the retaining rod 34 and the engagement rod 40 in a direction opposite that of the line 24. The lever 30 pulls the retaining rod 34 out of engagement with the spring posts 20. Simultaneously, the engagement rod 40 pulls the fork 42 toward the disk 52 and pushes the disk 52 towards the fitting 18. The sliding movement of the disk 52 slides the sliding rods 54 through the pillow block 56 and pushes the engagement disk 64 towards the fitting 18. The sliding movement of the engagement disk 64 pushes the engagement posts 66 between the spring posts 20. This simultaneous disengagement of the retaining rod 34 and engagement of the engagement posts 66 allows the auxiliary spring 12 to freely rotate, and thus transfers the torque of the auxiliary spring 12 to the pillow block 56 via the sliding rods 54 received therethrough, and then to the shaft 5 so as to assist in lifting the door coupled to the shaft 5.

Figure 7:
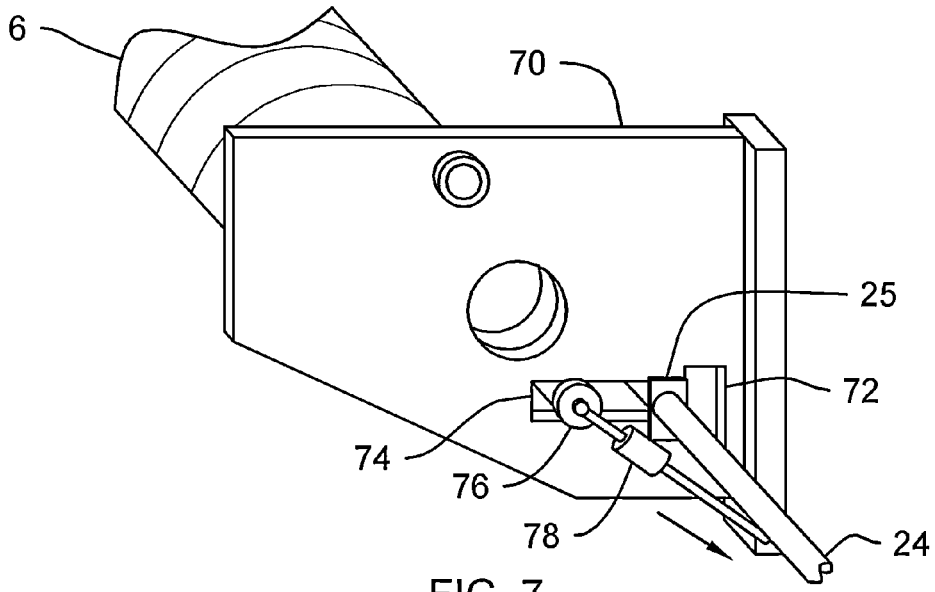
FIG. 7 is a side perspective view of the safety spring assembly of the overhead door backup spring system in the non-engaged position.
Figure 8:
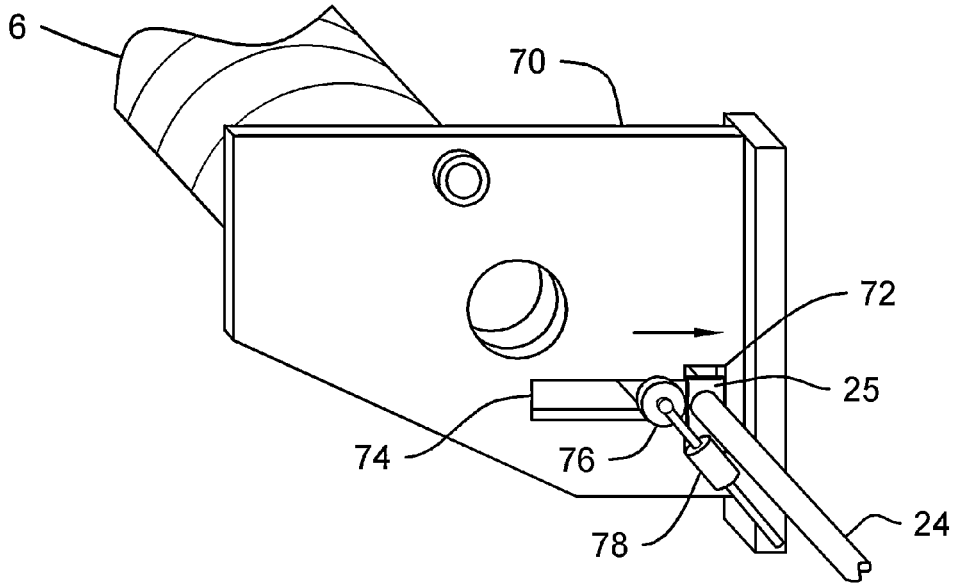
FIG. 8 is a side perspective view of the safety spring assembly of the overhead door backup spring system in the engaged position.

Regarding FIGS. 7 and 8, the backup spring system 10 can also include a safety assembly for the line 24, so as to prevent the line 24 from being activated when the main spring 6 is not broken. The safety assembly can be associated with the main spring bracket 7 or an additional main spring bracket 70. The bracket 70 features a first bore 72, and a second bore 74 in communication with the first bore 72. The line 24 passes through the first and second bores 72, 74 and includes a washer 25. The washer 25 is sized larger than the second bore 74 so as to prevent the washer 25 from passing therethrough when the user pulls on the line 24, as best illustrated in FIG. 7. The first bore 72 is configured to allow the washer 25 to pass therethrough.

A shoulder bolt 76 is connected to the main spring 6, and passes through the second bore 74. A safety spring 78 is connected to and pulls on the shoulder bolt 76; however the torque of a non-broken main spring 6 overcomes the pull of the safety spring 78.

In operation, when the main spring 6 fails, the safety spring 78 pulls the shoulder bolt 76 from one end of the second bore 74 toward the other end. The shoulder bolt 76 contacts the washer 25 and pushes it away from the second bore 74 and toward the first bore 72, as best illustrated in FIG. 8. Once the washer 25 is adjacent the first bore 72, then the user can pull the line 24 and the washer 25 will then pass freely through the first bore 72.

Figure 9:
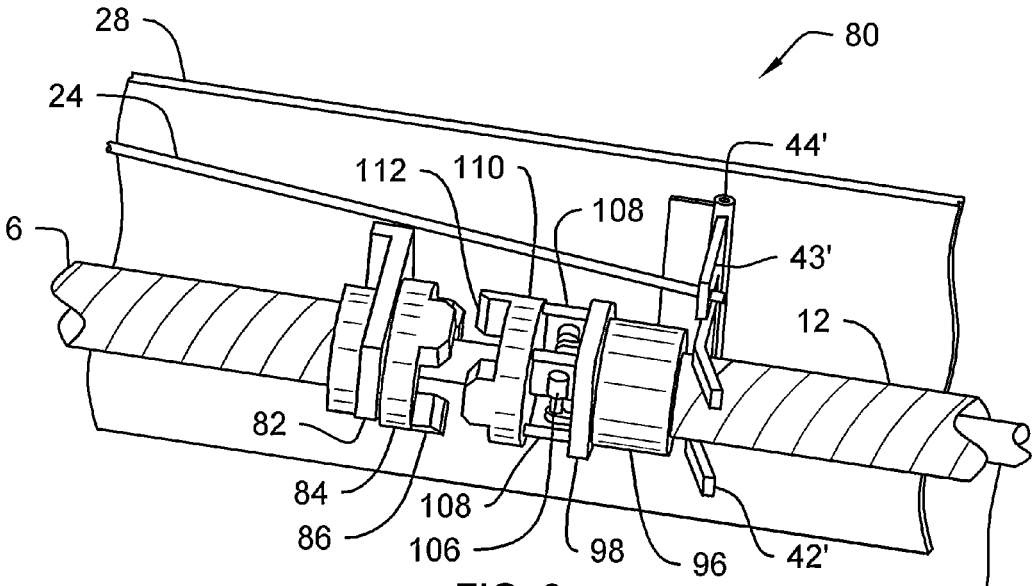
FIG. 9 is a top perspective view of an alternate embodiment of the overhead door backup spring system of the present invention.
Figure 10:
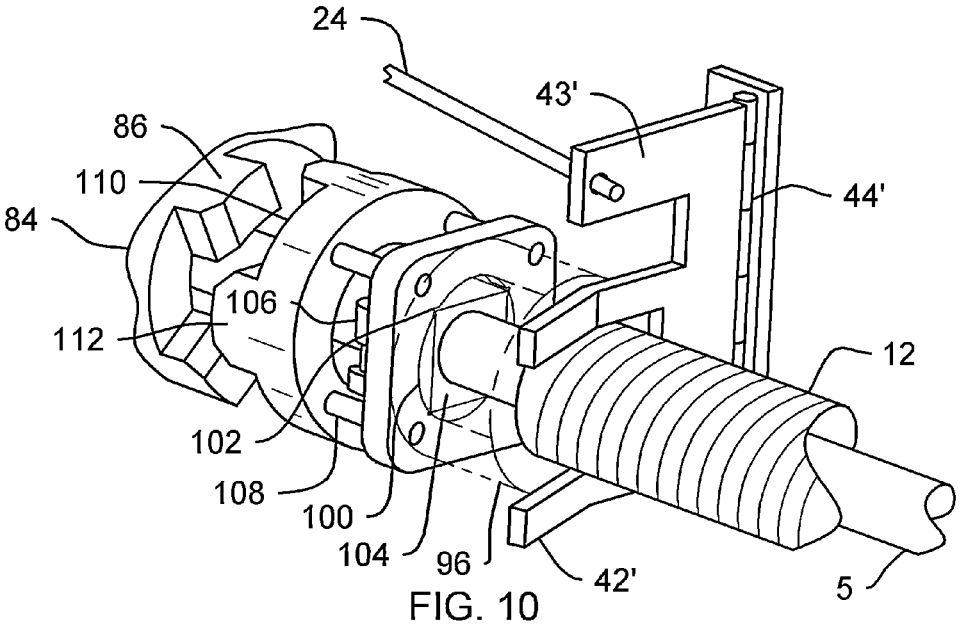
FIG. 10 is a side perspective view of the activation linkage and the backup spring engaging assembly of the alternate embodiment overhead door backup spring system of FIG. 9.

Regarding FIGS. 9 and 10, an alternate embodiment backup spring system 80 is described. The backup spring system 80 includes the auxiliary spring 12, a fork 42' activated by the line 24, and an engagement assembly. The main spring 6 is connected to the shaft 5 and a mounting bracket 82. A first engagement fitting 84 is rigidly connected to the shaft 5, and it includes a plurality of extensions 86 extending toward the auxiliary spring 12 parallel with the shaft 5.

The auxiliary spring 12 is secured at one end so as not to rotate, and includes a pillow block 96 at an opposite end adjacent the first engagement fitting 84. The fork 42' is pivotably connected to the wall or mount 28 via a hinge 44', and is activated by the line 24 via a fork extension 43'. The fork 42' is configured so that the auxiliary spring 12 passes through the forks, so as to make contact with the pillow block 96.

The engagement assembly includes a pillow block 96 which slides along the shaft 5 passing therethrough and is coupled to a disk 98. A bore 100 is defined through the center of the disk 98 and features multiple notches 102. A geometric stop block 104 is rigidly fitted to the shaft 5, and positioned so that its corners are received in the notches 102. The stop block 104 retains the auxiliary spring 12 in a pre-wound state.

A plurality of bearings or rollers 106 connected to the disk 98 contact the stop block 104 and allows the pillow block 96 and disk 98 to slide freely over the stop block 104 when acted upon by the fork 42'.

Multiple sliding posts 108 connect the disk 98 to a second engagement fitting 110 which includes a plurality of extensions 112 extending toward the first engagement fitting 84 parallel with the shaft 5. The extensions 112 of the second engagement fitting 110 are configured to mesh with the extensions 86 of the first engagement fitting 84 when moved into an engagement position by the fork 42'.

When the fork 42' is pivoted by the line 24, it pushes the pillow block 96, the disk 98 and the second engagement fitting 110 toward the first engagement fitting 84. The disk 98 travels over and past the stop block 104 so that the stop block 104 is received in a hollow interior of the pillow block 96, thereby allow the pillow block 96 to freely rotate around stop block 104. The extensions 112 of the second engagement fitting 110 engage with the extensions 86 of the first engagement fitting 84, thereby transferring the torque of the pre-wound auxiliary spring 12 to the shaft 5.

Figure 11:
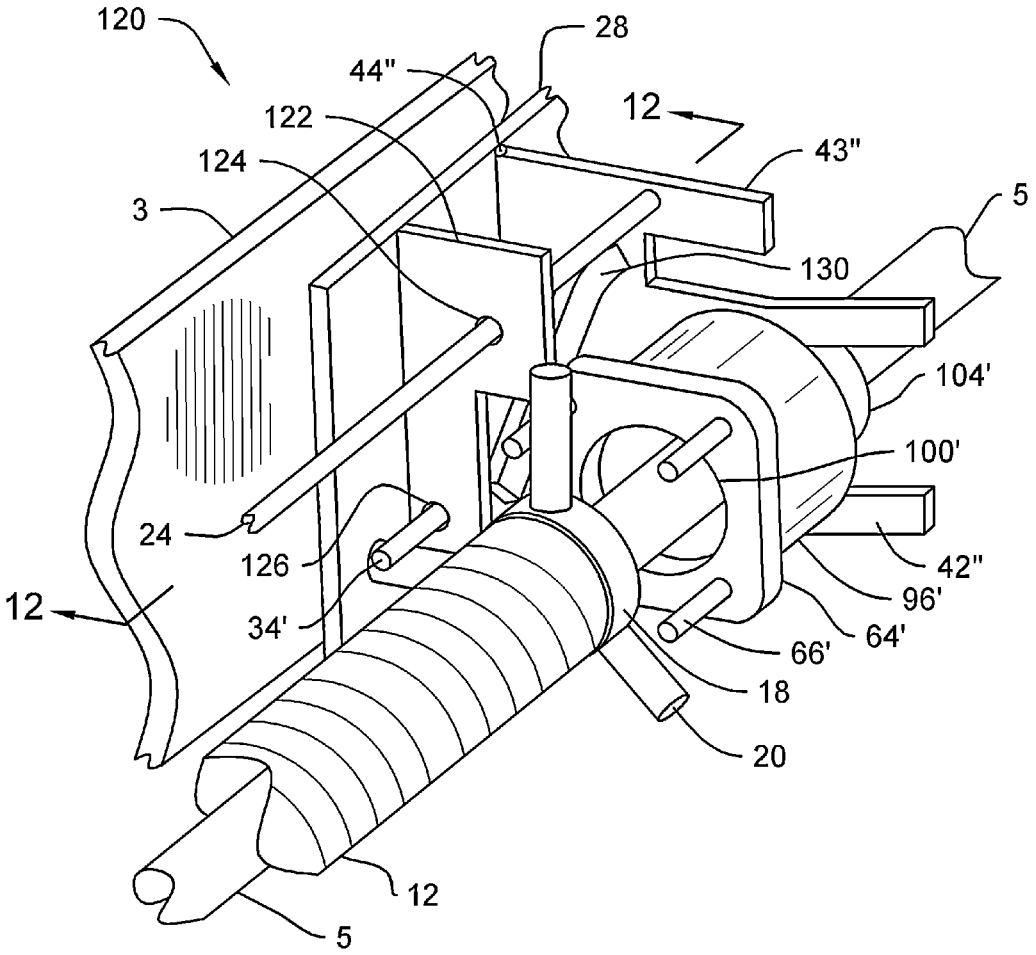
FIG. 11 is a side perspective view of an alternate embodiment of the overhead door backup spring system of the present invention.

Regarding FIG. 11, an alternate embodiment backup spring system 120 is described. The backup spring system 120 includes the auxiliary spring 12, a control lever 130, a fork 42" and an engagement assembly. The auxiliary spring 12 is held in a coiled state by the control lever 130, thereby storing potential energy or torque and releasing such upon activation of the line 24 by the user. The control lever 130 and the fork 42" simultaneously release the torque energy of the auxiliary spring 12 and transfer it to the engagement assembly, which then transfer it to the shaft 5.

The auxiliary spring 12 is attached to a mounting bracket via a coupler at a first end, which secures the first end of the auxiliary spring 12 to the mounting bracket and prevents the auxiliary spring 12 from rotating. A second end of the auxiliary spring 12 includes the fitting 18 featuring the spring posts 20 extending radially outwardly therefrom. The second end of the auxiliary spring 12 and fitting 18 are configured to be rotatable about the shaft 5.

Figure 12:
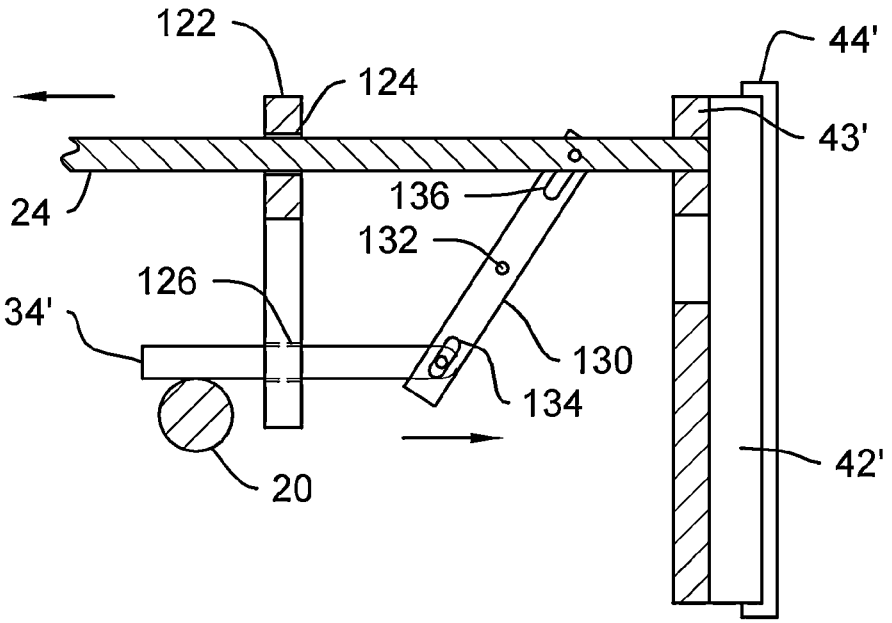
FIG. 12 is a cross-sectional view of the activation linkage of the alternate embodiment overhead door backup spring system in the non-engaged position taken along line 12-12 of FIG. 11.
Figure 13:
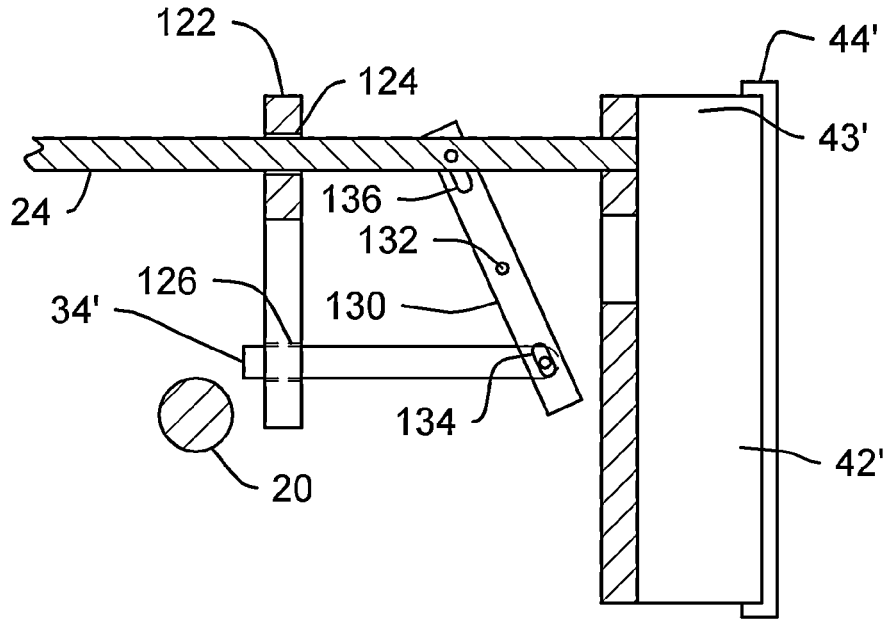
FIG. 13 is a cross-sectional view of the activation linkage of the alternate embodiment overhead door backup spring system of FIG. 11 in the engaged position.

The control lever 130 and a control bracket 122 can be fitted to the mount 28 which is attached to the beam 3 or directly to the beam 3. The line 24 passes through a first bore 124 defined through the control bracket 122 and is coupled to the control lever 130 and the fork 42". The fork is pivotably connected to the mount 28 via a hinge 44", and the control lever 130 is pivotably mounted to the mount 28 via a pivot pin or hinge 132, as best illustrated in FIGS. 12 and 13. The fork 42" is moved upon activation of the line 24 and is configured so that the shaft 5 passes between forks.

The hinge 132 is located between free ends of the control lever 130, with the line 24 coupled at one end and a retaining rod 34' coupled to an opposite end. The retaining rod 34' passes through a second bore 126 defined through the control bracket 122. The second bore 126 hold the torque of the auxiliary spring 12 in a pre-wound state, thus creating the potential energy or torque required to rotate the shaft 5 upon activation. The retaining rod 34' extends out past the control bracket 122 so as to protrude between the spring posts 20 and thus engage with one of the spring posts 20 to hold the auxiliary spring 12 in the pre-wound state.

The engagement assembly includes a pillow block 96' which slides along a stop block 104' that is rigidly attached to the shaft 5. An engagement disk 64' is fitted to the pillow block. A bore 100' is defined through the center of the engagement disk 64' and is configured to receive the shaft 5 therethrough. The stop block 104' is rigidly fitted to the shaft 5, and is configured to retain the pillow block 96' and transfer any rotational movement to the shaft 5. The pillow block 56' is slidable on the stop block 104', and has a surface configured to contact the fork 42".

The engagement disk 64' includes a plurality of engagement posts 66' extending away from the engagement disk 64' toward the fitting 18, wherein the engagement posts 66' are parallel with the shaft 5. The engagement posts 66' are configured to engage with the spring posts 20, upon movement of the engagement disk 64' produced by the fork 42".

Regarding FIG. 12, the control lever 130, the fork 42", and engagement disk 64' are in a non-engaged position. In the non-engaged position, the retaining rod 34' is between the spring posts 20 and in contact with at least one of the spring posts 20. The fork 42" is not engaged with the disk 52, so the disk 52 and the engagement disk 64 are positioned away from the auxiliary spring 12, thus the engagement posts 66' are not located between the spring posts 20. The second bore 126 holds the retaining rod 34' in place, preventing the retaining rod 34' from moving upward or downward by the resulting torque from the pre-wound auxiliary spring 12.

The control lever 130 may include a line slot 136 and a rod slot 134 which allow for rotational movement of the control lever 130 with lateral movement of the line 24 and retaining rod 34'.

Regarding FIG. 13, the user would pull on the line 24, thereby pivoting the control lever 130 about the hinge 132 and thus pulling the retaining rod 34' in a direction opposite that of the line 24. The control lever 130 pulls the retaining rod 34' out of engagement with the spring posts 20. Simultaneously, the line 24 pulls the fork 42" toward the pillow block 96', which pushes the pillow block 96' and engagement disk 64' towards the fitting 18. This simultaneous disengagement of the retaining rod 34' and engagement of the engagement posts 66' allows the auxiliary spring 12 to freely rotate, and thus transfers the torque of the auxiliary spring 12 to the pillow block 96' via the stop block 104', and then to the shaft 5 so as to assist in lifting the door coupled to the shaft 5.

In FIGS. 14-26, an alternate embodiment of the overhead door backup spring system of the present invention is shown and generally designated by the reference numeral 200.

The alternate overhead door backup spring system 200 of the present invention for providing an emergency spring counterweight for overhead doors upon failure of a main spring counterweight is illustrated and will be described. More particularly, the backup spring system 200 can be retrofitted to an existing overhead door spring and shaft assembly. It can be appreciated that the backup spring system 200 can be integrated in new overhead door spring and shaft assemblies.

Figure 14:
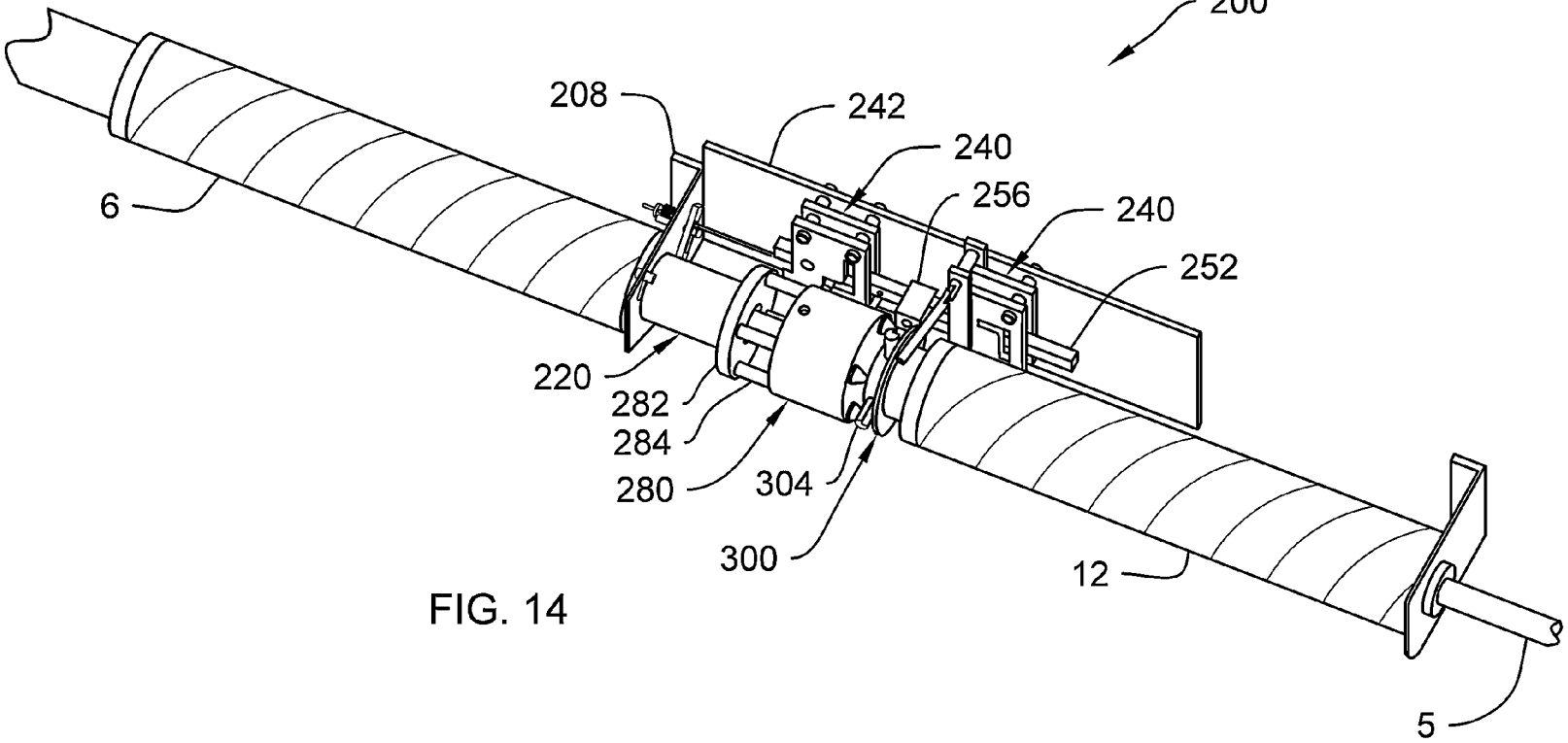
FIG. 14 is a top perspective view of an alternate embodiment overhead door backup spring system of the present invention.
Figure 15:
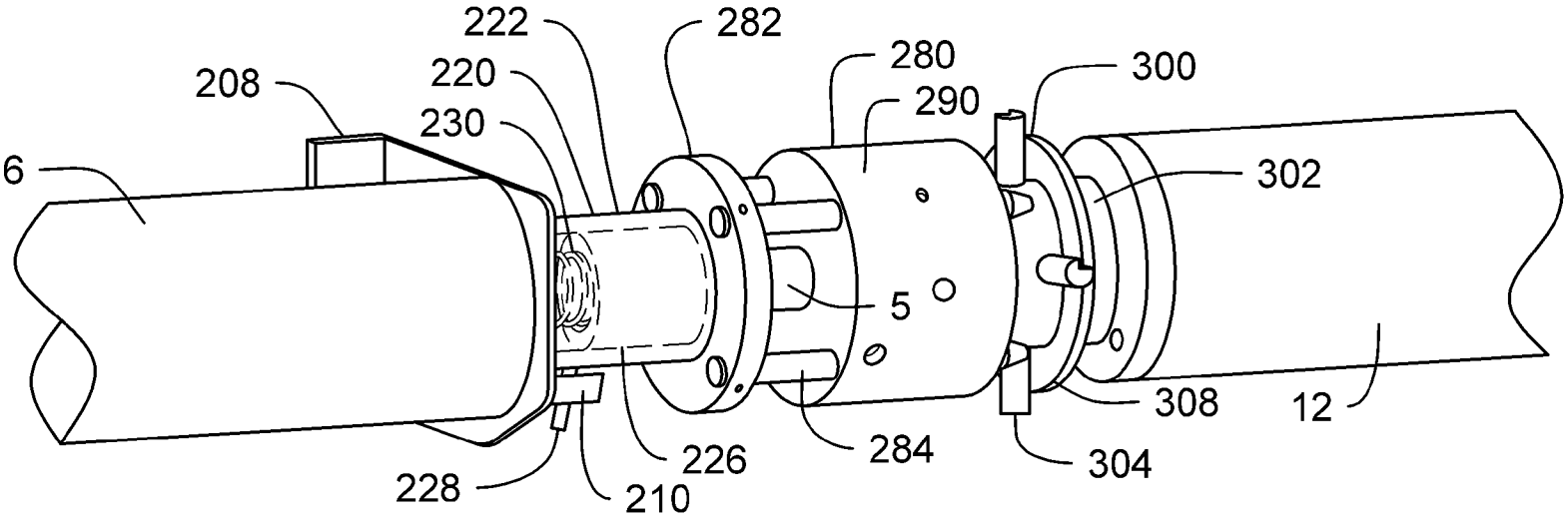
FIG. 15 is a front perspective view of the alternate embodiment overhead door backup spring system with the control assembly removed for clarity and the plunger sleeve being transparent so as to view the interior of the activation unit.

Regarding FIG. 14, the backup spring system 200 includes an auxiliary spring 12, an activation unit 220, a control assembly 240, an engagement assembly 280, and an auxiliary spring engagement assembly 300. The auxiliary spring 12 is held in a coiled state by the control assembly 240, thereby storing potential energy or torque and releasing such upon activation of by the backup spring system 200 automatically upon failure of the main spring 6. The activation unit 220 automatically activates the control assembly 240 which simultaneously releases the torque energy of the auxiliary spring 12 and transfers it to the engagement assembly 280, which then transfer it to the shaft 5.

The auxiliary spring 12, can be but not limited to, a coil spring fitted over the shaft 5 so that the shaft is received in the auxiliary spring 12. The auxiliary spring 12 is attached to a mounting bracket 208, and a spring pin 204 and bracket slot 205 arrangements which prevents the main spring 6 from rotating until failure. While the auxiliary spring 12 is retained in a torqued or tensioned position by the control assembly 240 and engagement assembly 280.

Figure 16:
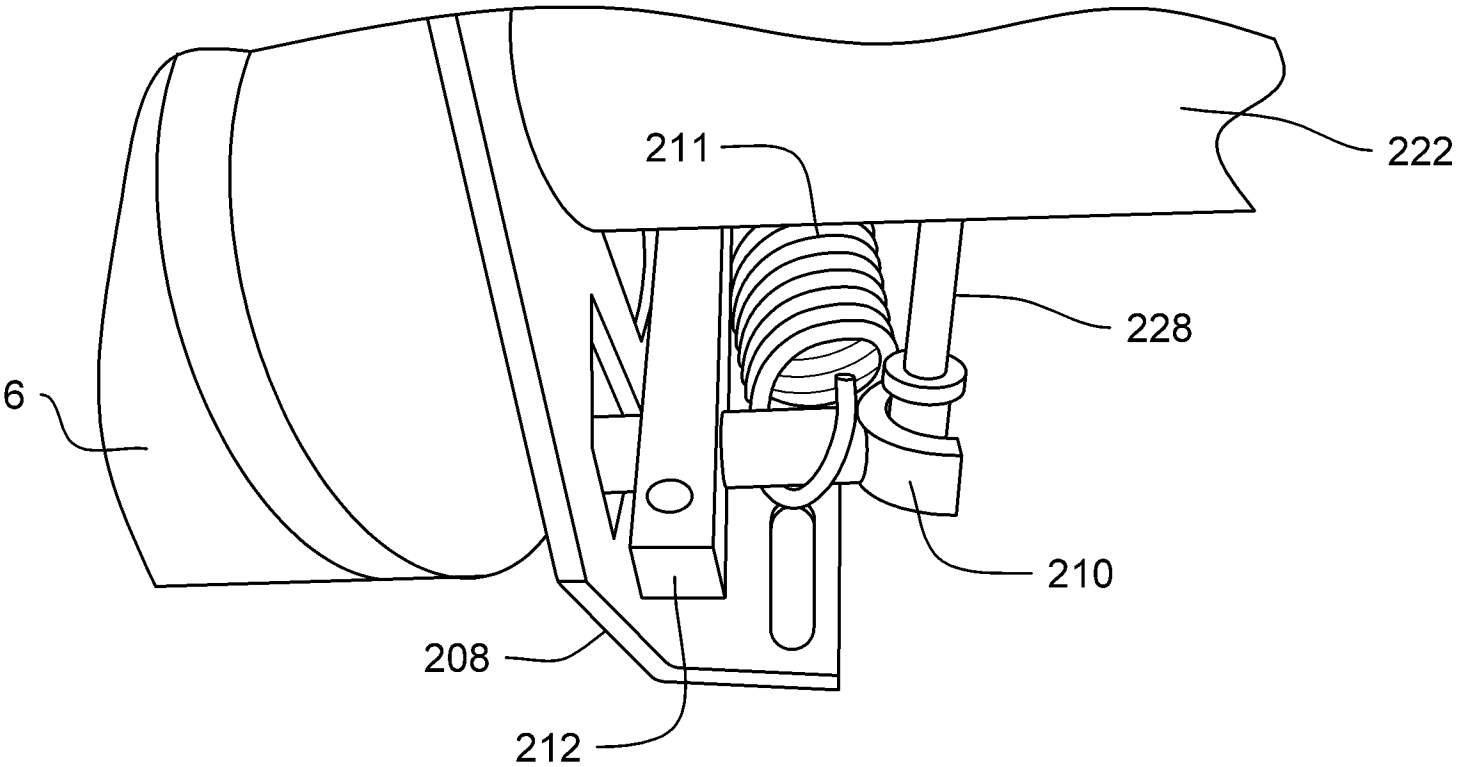
FIG. 16 is a perspective view of the activation unit of the alternate embodiment overhead door backup spring system of the present invention.

Referencing FIGS. 14-17, the activation unit 220 includes an activation bar 210 coupled to the main spring 6, so as to rotate about the shaft 5 upon failure of the main spring 6. The torque of the main spring 6 keeps the activation bar 210 in the non-engagement position and is retained by a side edge of a slot defined in the bracket 208. An activation spring 211 is attached to the bracket 208 and to the activation bar 210 to provide a pulling force that counteracts the torque of the main spring 6, as best illustrated in FIG. 16. The pulling force of the activation spring 211 is less than the torque of the main spring 6. Upon failure of the main spring 6 its torque is reduced below the pulling force of the activation spring 211. The activation spring 211 is now able to pull the activation bar 210 into the engaged position.

A release member or bar 212 is attached to and able to move with the activation bar 212 upon failure of the main spring 6. The release member 212 can include a bore configured to receive the activation bar 212 therethrough, or a bracket attachable to the activation bar 212. The release member 212 is operated by the activation bar 210 so as to rotate or move along a pin 214 by way of a slot 213 defined through the release member 212.

A linkage can be used to operate the control assembly 240. The linkage can include a stop 216 is fitted to a control shaft or line 218, and is biased by a stop spring 217 located to produce a force on the control shaft 218. In the non-engagement position, the release member 212 prevents the stop 216 from moving, thus retaining the control shaft 218 in position. When the release member 212 is operated by the activation bar 210, the slot 213 is aligned with the stop 216 thereby allowed the spring 217 to move the control shaft 218.

Figure 17:
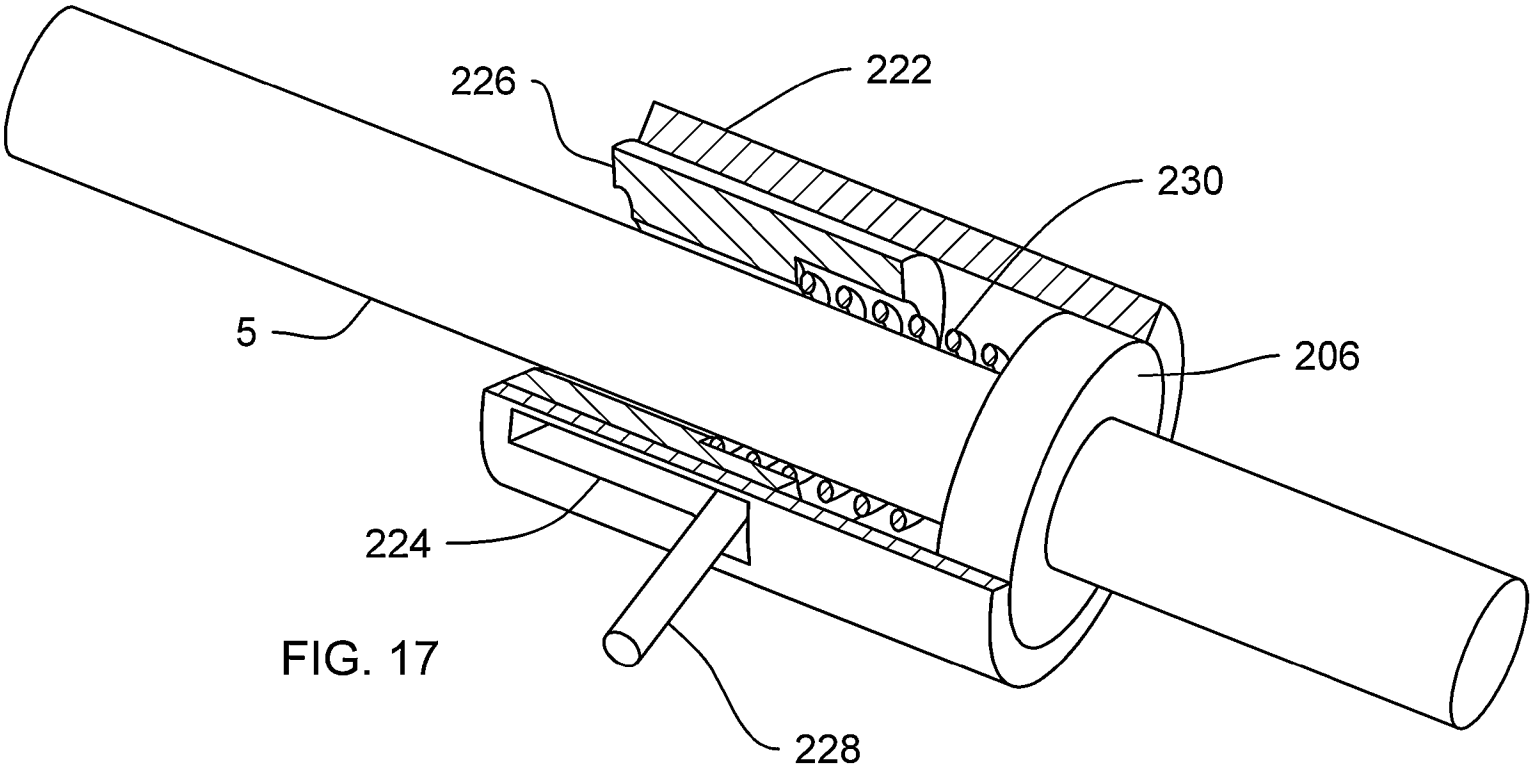
FIG. 17 is a cut-away perspective view of the activation unit of the alternate embodiment overhead door backup spring system of the present invention.

A plunger sleeve 222 extends from the bracket 208, opposite the main spring 6, and is secured to the bracket 208 or to the shaft 5 by a bearing 206. The plunger sleeve 222 includes a J-shaped or L-shaped slot 224, as best illustrated in FIG. 17.

A plunger 226 is slidably received in the plunger sleeve 222, and is biased away from the bracket 208 by a plunger spring 230. The plunger 226 includes a plunger pin 228 extending through the slot 224 and which is in operable location with the activation bar 210. The plunger 226 can also include a recess configured to receive a first end of the plunger spring 230, while a second of the plunger spring 230 abuts the bearing 206 or bracket 208. The activation bar 210 can have a forked end so as to receive a section or the plunger pin 228.

The shape of the slot 224 prevents the plunger 226 from moving away from the bracket 208 in a non-engaged position because a wall or edge of the slot 224 contacts the plunger pin 228 in a direction substantially perpendicular to the sliding movement of the plunger 226 produced by the plunger spring 230. Once the plunger pin 228 is rotated by the activation bar 210 upon failure of the main spring 6 to an engaged position where the plunger pin 228 is free to travel down the slot 224 thereby allowing the plunger 226 to move away from the bracket 208.

Figure 18:
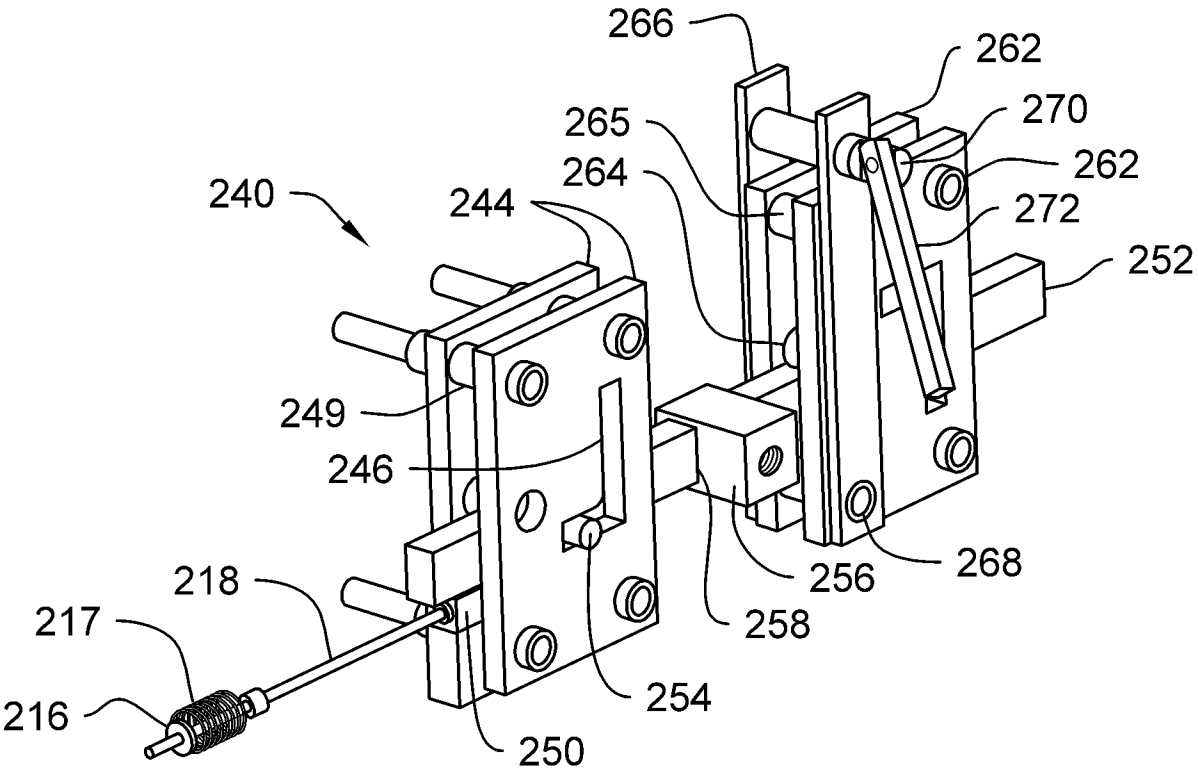
FIG. 18 is a front perspective view of the control assembly of the alternate embodiment overhead door backup spring system of the present invention.
Figure 19:
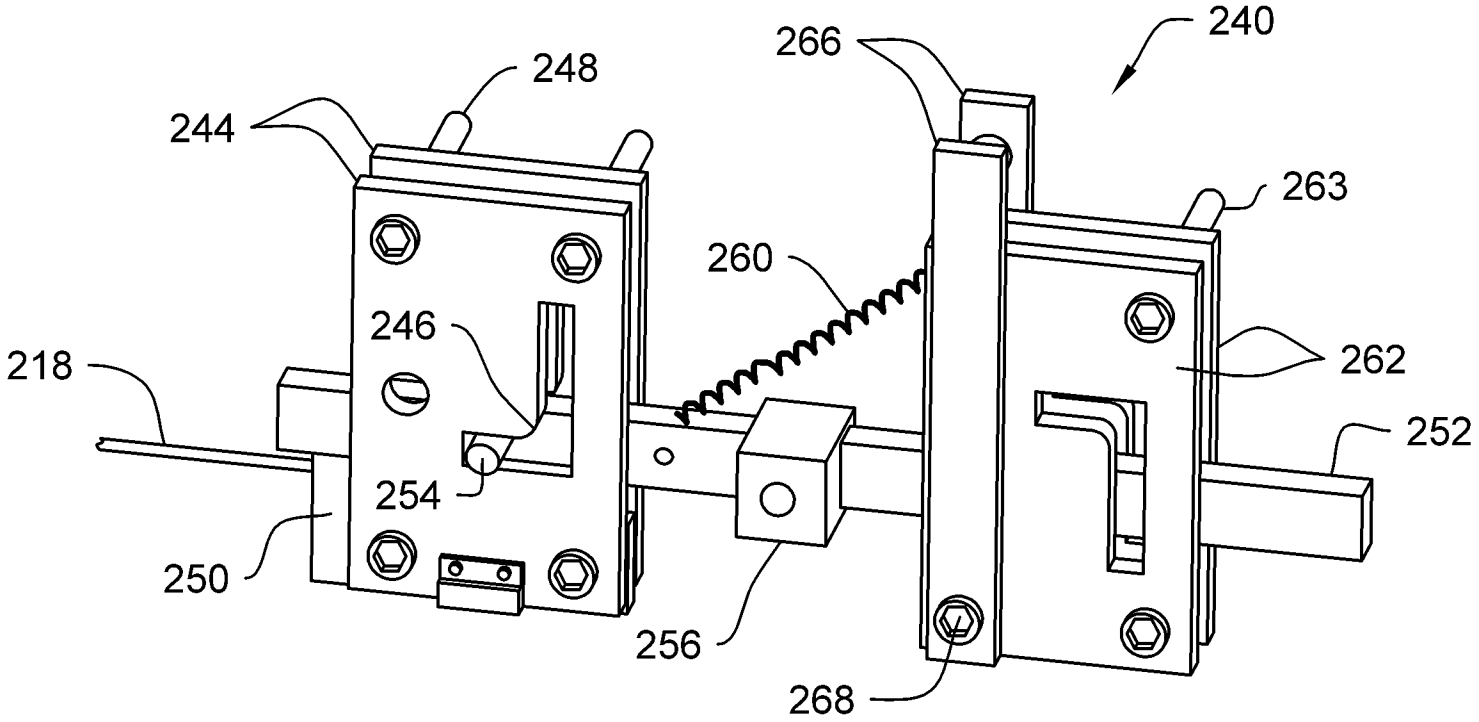
FIG. 19 is a front perspective view of the control assembly of the alternate embodiment overhead door backup spring system of the present invention.
Figure 20:
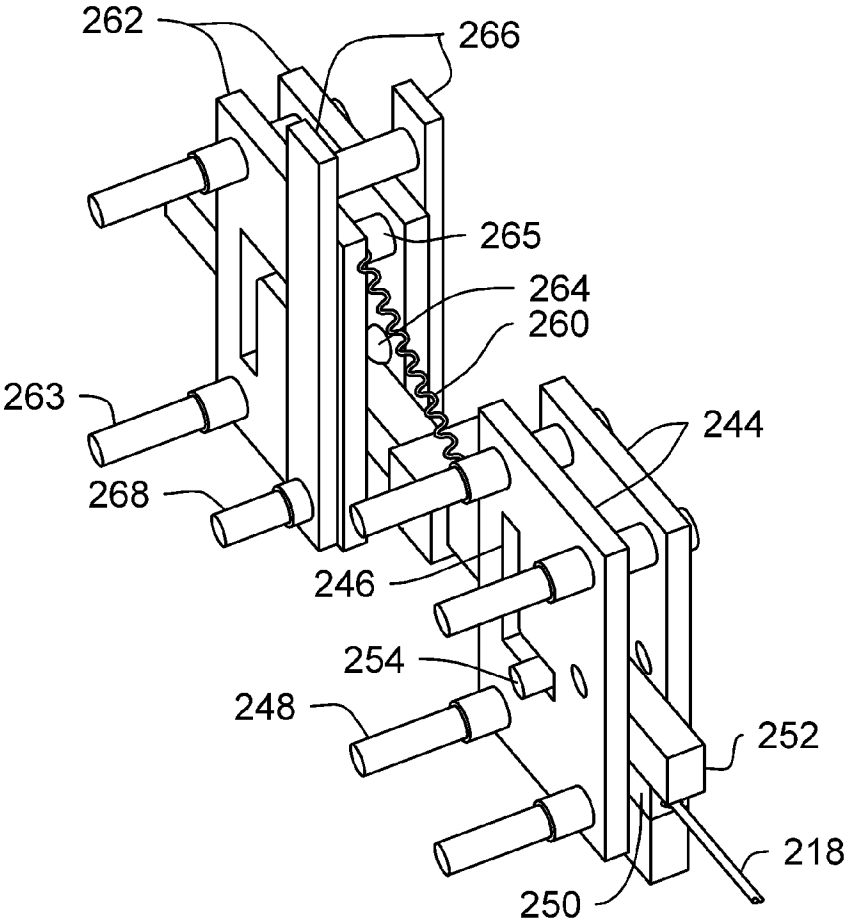
FIG. 20 is a rear perspective view of the control assembly of the alternate embodiment overhead door backup spring system of the present invention.

Referencing FIGS. 18-20, the control assembly 240 includes first and second plate assemblies in a spaced relationship with each other. The first plate assembly includes a pair of first plates 244 mounted to a wall or mount 242 via a plurality of fasteners 248. The first plates 244 are spaced apart from each other via spacers 249 located about the fasteners 248, thus created a gap between the first plates 244. The first plates 244 define corresponding J-shaped or L-shaped plate slots 246 that are aligned with each other. The plate slots 246 include a first section parallel with a longitudinal axis of the control shaft 218, and a second section that is perpendicular to the longitudinal axis of the control shaft 218.

A control shaft block 250 is fitted to an end of the control shaft 218, and is slidably or moveably received in the gap between the first plates 244. The control shaft black 250 can be located so as to slidably rest upon at least one of the spacers 249, thereby providing support for the control shaft block 250.

The second plate assembly includes a pair of second plates 262 mounted to the wall or mount 242 via a plurality of fasteners 263. The second plates 262 are spaced apart from each other via spacers 249 located about the fasteners 263, thus created a gap between the second plates 262. The second plates 262 can also define corresponding J-shaped or L-shaped plate slots so that first plates can be used to produce the second plates 262. Each of the second plates 262 includes facing detents or bumps 264.

A control bar 252 is slidably received in the gaps of the first and second plates 244, 262. The control bar 252 includes a post 254 that is received in the plate slots 246, and an engagement block 256 located between the first and second plate assemblies. The engagement block 256 defines a bore 258 configured to receive the control bar 252, and a set screw configured to secure the engagement block 256 to the control bar 252 in an adjustable position.

The section of the control bar 252 located between the second plates 262 is positioned so as to be adjacent with and below the detents 264, thereby creating a pivot point while allowing the control bar 252 to slide there along.

A control bar spring 260 is connected to a spacer or pin 265 located near a top of the second plates 262, and to the control bar 252 at a location between adjacent or near the first plates 244 or the engagement block 256, as best illustrated in FIGS. 18 and 19. The control bar spring 260 produces an upward force on the control bar 252.

The control shaft block 250 is operable coupled to an end section of the control bar 252 so as to slide or move the control bar 252 upon movement of the control shaft 218. When the control bar 252 moves, the post 254 slides along the first section of the plate slots 246 prevents the control bar 252 from moving upward until it is aligned with the second section of the plate slots 246. At this position, the control bar spring 260 pulls on the control bar 252 thereby pivoting it against the detents 264 and lifting the post 254 up the second section of the plate slots 246.

An engagement lever assembly is pivotably connected to the second plates 262 via a pair of lever members 266 which are spaced apart from each other so as to receive the second plates 262 therebetween. A first end of the lever members 266 are pivotably fitted to at least one of the second plate fasteners 268 located near a lower corner of the second plates 262. A second end of the lever members 266 extend past the second plates 262. A first lever bar 270 extends from the second end of the lever members 266 and includes a linkage end.

A second lever bar 272 includes a linkage end connected to the linkage end of the first lever bar 270 so as to extend the second lever bar 272 away from the first lever bar 270 at an angle different from the first lever bar 270. The first lever bar 270 can be rotatably connected to the lever members 266, and/or the second lever bar 272 can be pivotably connected to the first lever bar 270. The first lever bar 270 can be biased by a spring so as to rotate the second lever bar 272 in a predetermined direction.

Figure 21:
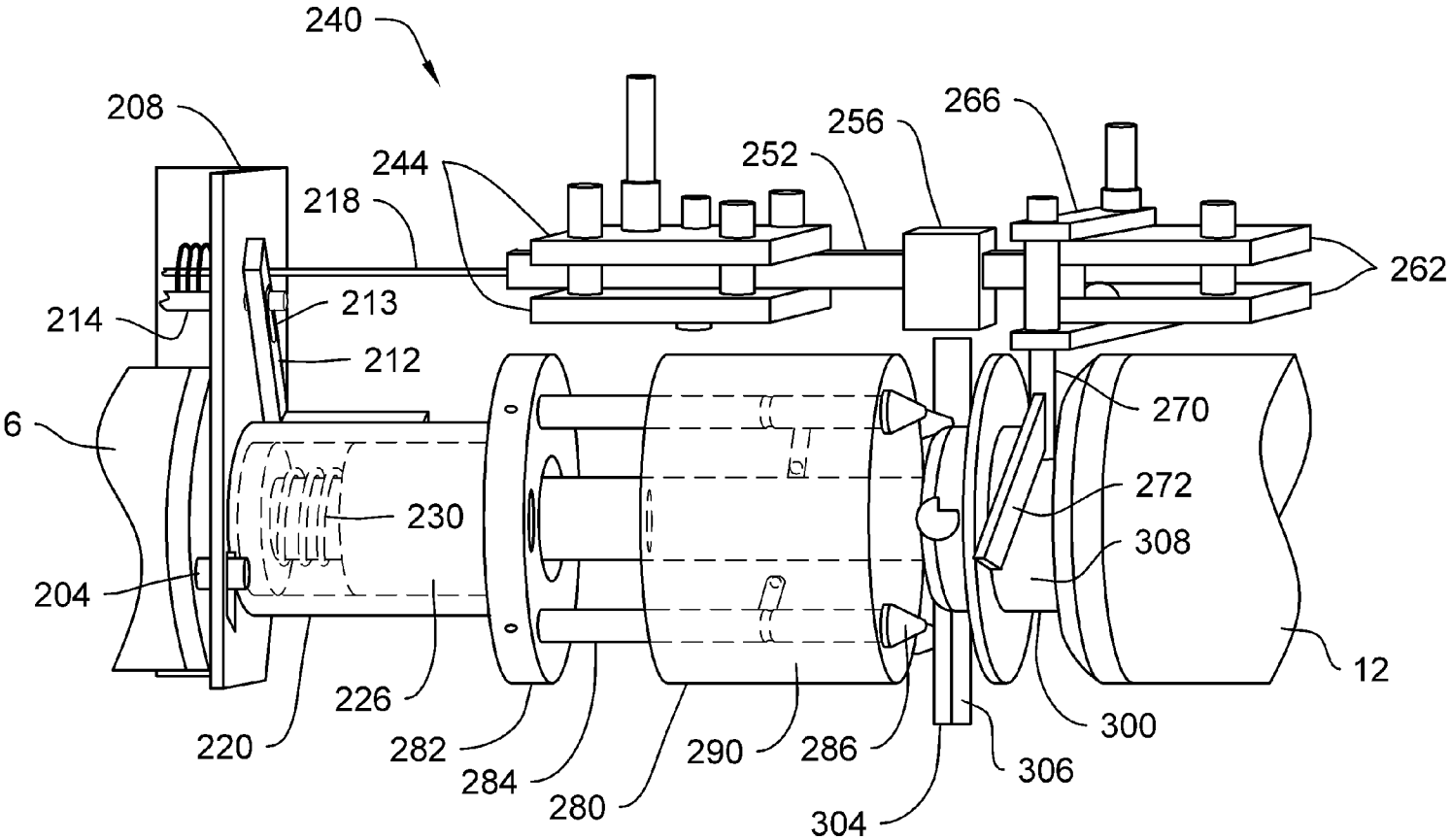
FIG. 21 is a top perspective view of the engagement assembly of the alternate embodiment overhead door backup spring system of the present invention with a transparent plunger sleeve and a transparent pillow block.
Figure 22:
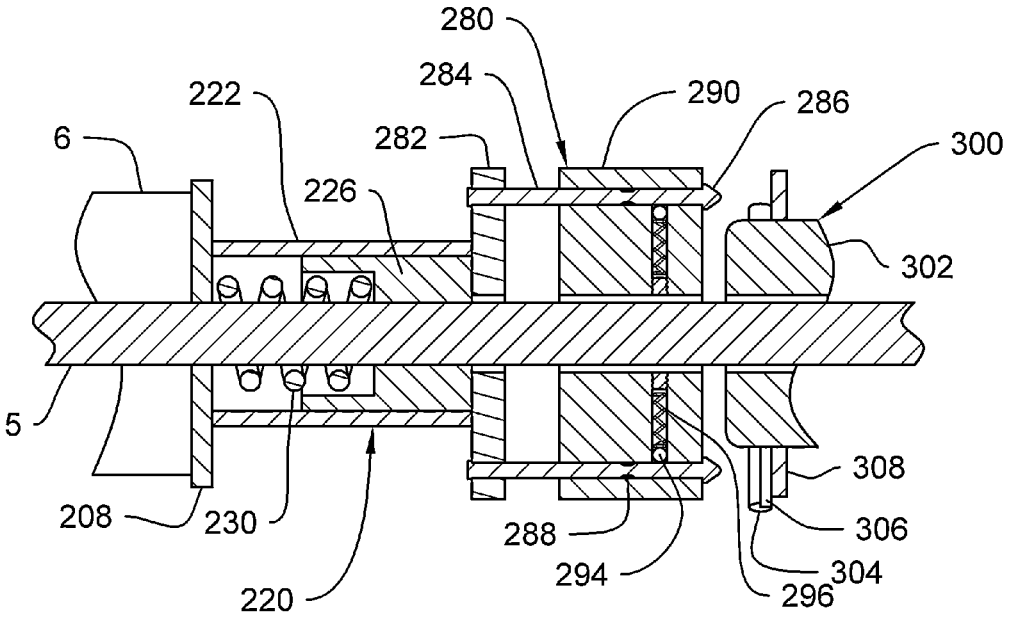
FIG. 22 is a cross-sectional view of the activation unit and engagement assembly in the non-engaged position.
Figure 23:
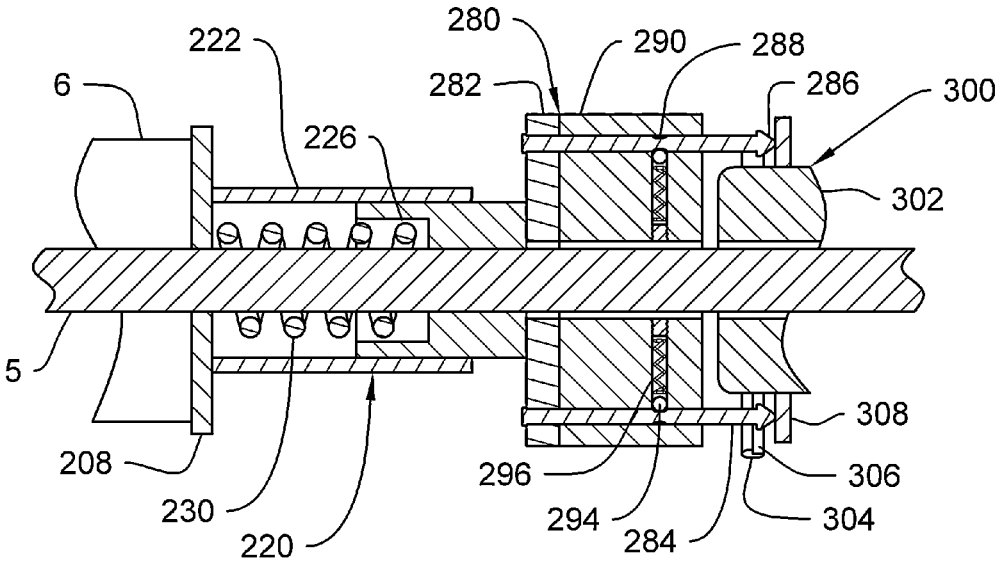
FIG. 23 is a cross-sectional view of the activation unit and engagement assembly in the engaged position

Referencing FIGS. 21-23, the engagement assembly 280 features a central bore configured to receive the shaft 5 therethrough, and includes an engagement disk 282, a pillow block 290 and the auxiliary spring engagement assembly 300.

The engagement disk 282 includes a plurality of engagement posts 284 extending away from the engagement disk 282 toward the pillow block 290, wherein the engagement posts 284 are parallel with the shaft 5. Each of the engagement posts 284 includes an annular recess 288 located at predetermined distance on the posts 284, and a tapered free end 286. The free end 286 features a base having a diameter larger than a diameter of it respective post 284 to create a ledge, and a tapering tip.

The engagement disk 282 also includes a surface configured to rotatably contact the plunger 226, and is configured to slide along the shaft 5 when operated by movement of the plunger 226. The engagement disk 282 can slide along the shaft 5 by way of a linear or thrust bearing. It can be appreciated that the engagement disk 282 and/or the plunger 226 and/or the plunger sleeve 222 can include a magnet (not shown) to assist retaining the engagement disk 282 in the non-engaged position.

The pillow block 290 is located between the engagement disk 282 and the free end 286 of the engagement posts 284, and is retained therebetween by the ledge of the free end 286. The pillow block 290 features a cutout or keyway 298 that has a threaded bore therethrough for receiving a set screw 299. The set screw 299 is configured to engage with the shaft 5 and retain the pillow block 290 to the shaft 5 while preventing the pillow block 290 from rotating about the shaft 5. The keyway 298 allows the position of the pillow block 290 on the shaft 5 to be adjusted.

The pillow block 290 includes a plurality of longitudinal bores 292, and a plurality of retention balls 294 each being moveably located in bores defined in the pillow block 290. The bores associated the retention balls 294 are in communication with one of the longitudinal bores 292, and it can be appreciated that these bores are defined from the interior or exterior of the pillow block 290. The longitudinal bores 292 are each configured to slidably receive at least one of the engagement posts 284 therethrough from the non-engaged position to the engaged position. Each of the retention balls 294 includes a spring for biasing the ball 294 toward the engagement post 284. When the annular recess 288 of the engagement post 284 is aligned with a corresponding ball 294, the ball is received in the recess 288 to retain the engagement post 284 in a predetermined position.

The auxiliary spring engagement assembly 300 is located at an end of the auxiliary spring 12, and includes a cylindrical extension 302, a plurality of spring posts 304 extending radially outward from the cylindrical extension 302, and a spring post disk 308 located between the spring posts 304 and an end of the backup spring 12. The auxiliary spring engagement assembly 300 is rotatably supported about the shaft 5 by a bearing. The cylindrical extension 302 has a diameter that allows it to be received between the free ends 286 of the engagement posts 284.

Each of the spring posts 304 include a notch 306 configured to receive at least one of the ledges created by the free end 286 of the engagement post 284, when the engagement posts 284 are in the engaged position. The notches 306 retain engagement between the engagement posts 284 and the spring posts 304 while preventing the engagement posts 284 from retracting back to the non-engaged position until desired by the user. The spring posts 304 have a length allowing at least one of them to contact and abut against the engagement block 256, thereby retaining the auxiliary spring 12 in a pre-wound stated. The auxiliary spring 12 is allowed to transfer its torque to the engagement posts 284 when in the engaged position because the engagement block 256 is moved out of contact with the spring post 304.

The spring post disk 308 is slidable along the cylindrical extension 30, and has a diameter allowing contact with free end of the second lever bar 272. The spring post disk 308 is pushed toward the spring posts 304 by the biased force of the second lever bar 272. The spring post disk 308 has a surface configured to be contacted by the tip of the free end 286 of the engagement posts 284 in the engaged position. The biasing force of the second lever bar 272 against the spring post disk 308 keeps the free ends 286 of the engagement posts 284 from advancing into the engaged position until desired.

Figure 24:
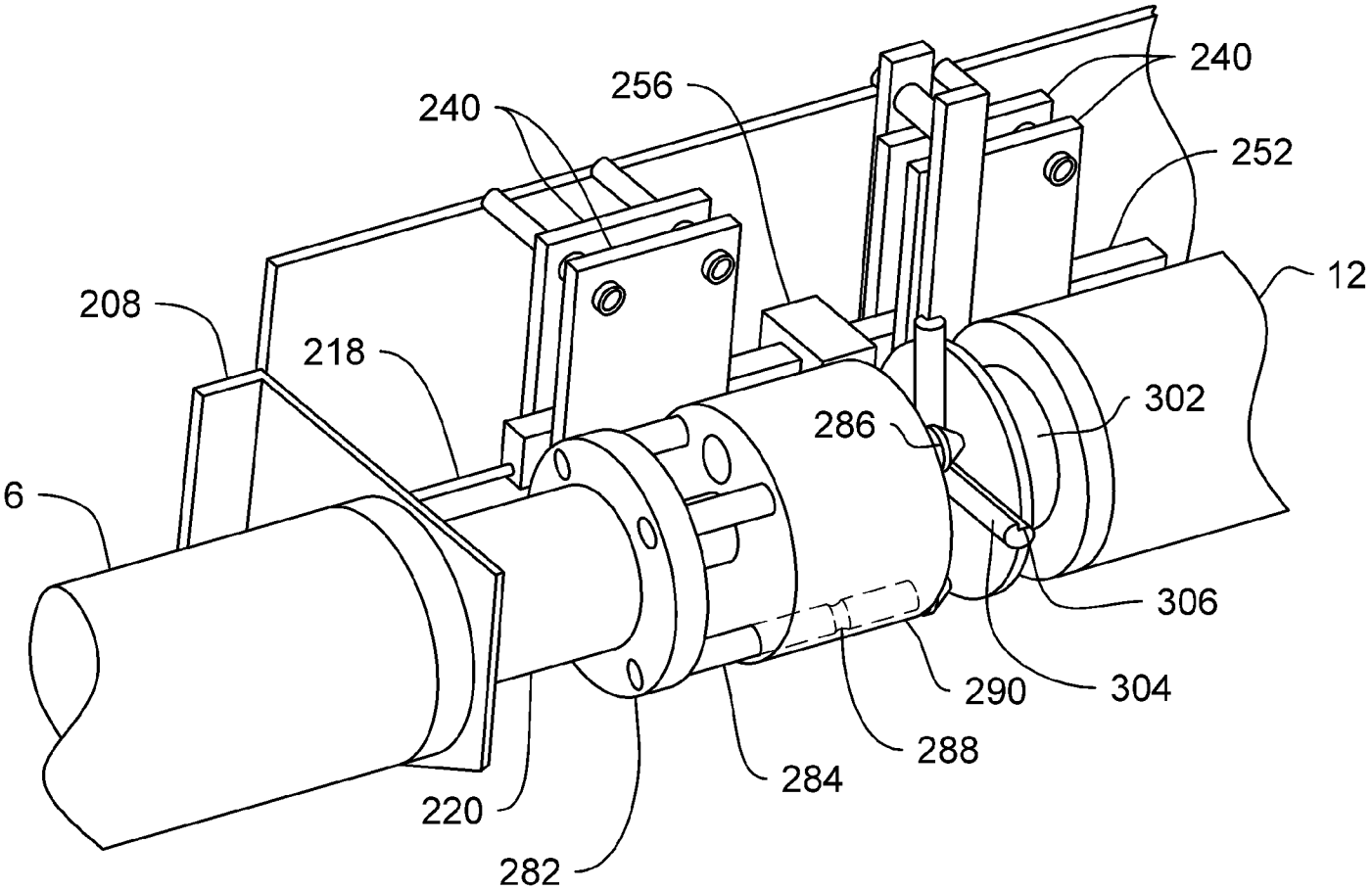
FIG. 24 is a front perspective view of the alternate embodiment overhead door backup spring system of the present invention.
Figure 25:
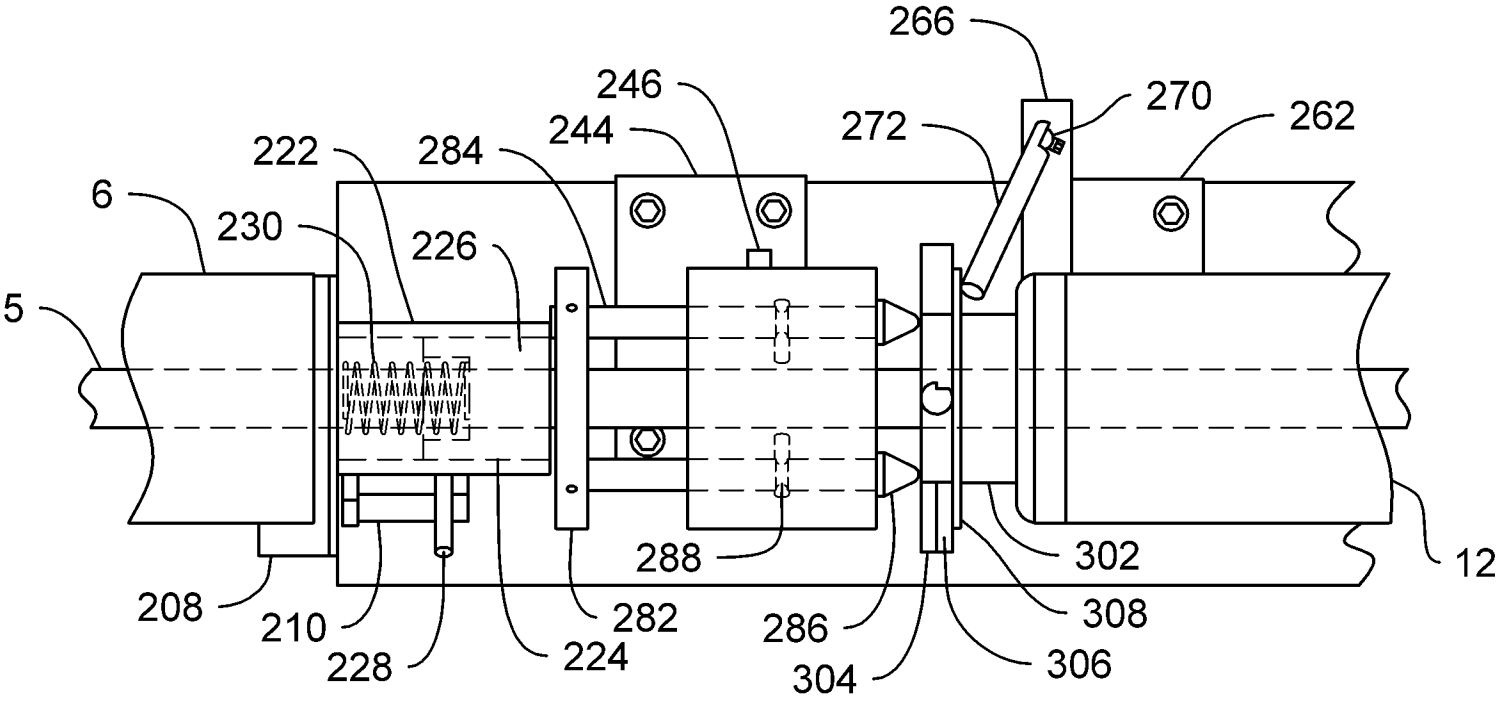
FIG. 25 is a front side view of the alternate embodiment overhead door backup spring system of the present invention.
Figure 26:
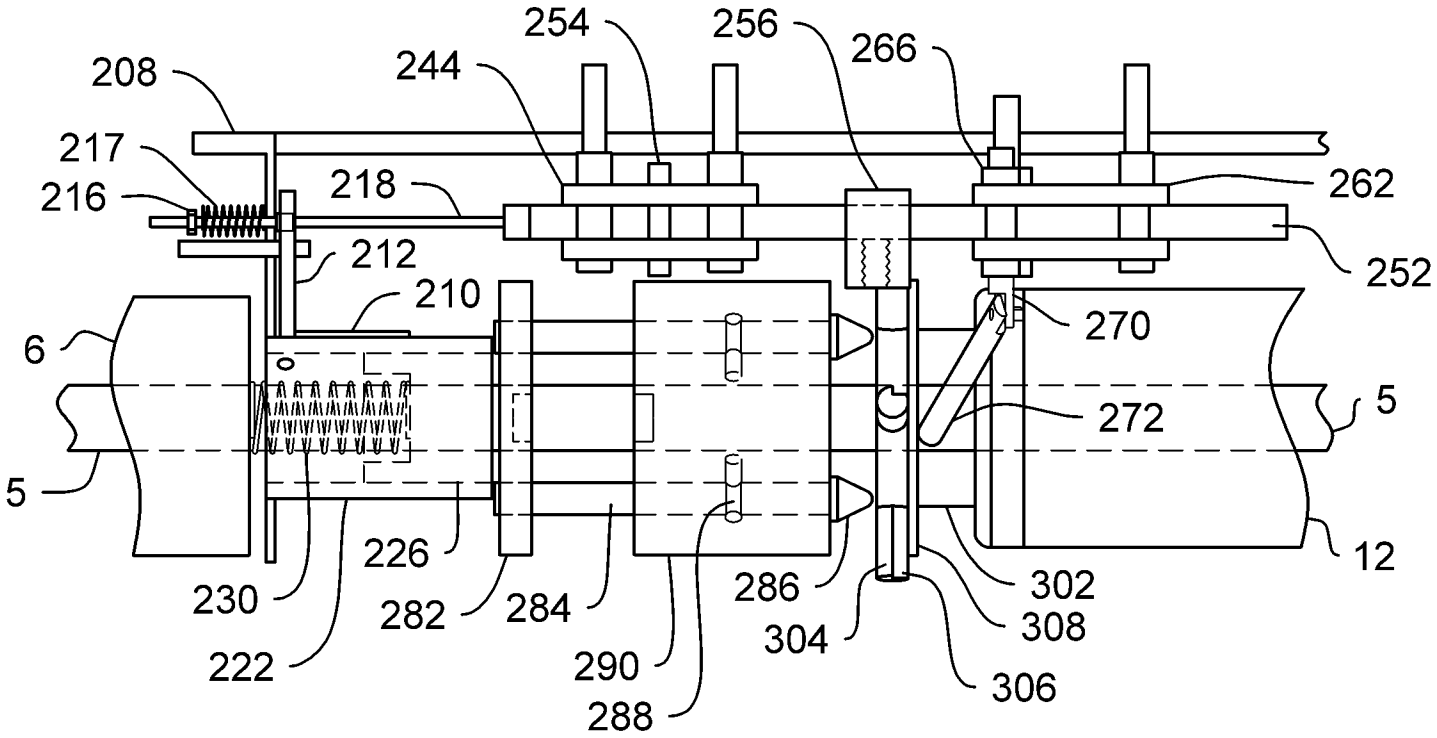
FIG. 26 is a top elevational view of the alternate embodiment overhead door backup spring system of the present invention.

In operation, as best illustrated in FIGS. 24-26, the alternate embodiment backup spring system 200 is initially in the non-engaged position where the activation unit 220 is not activated and the plunger 226 is retracted, the control bar 252 is not pivoted and the post 254 is in the first section of the plate slots 246, the engagement block 256 is in contact with at least one of the spring posts 304, and the engagement posts 284 are not engaged with the spring posts 304.

In this non-engaged position, the torque of the pre-wound auxiliary spring 12 is retained as potential energy by the engagement block 256 in contact with at least one of the spring posts 304. The main spring 6 and shaft 5 are allowed to rotated and operate normally because the activation bar 210 abuts the edge of the slot in the bracket 208 by the torque of the main spring 6. The spring post disk 308 is urged toward the spring posts 304 by the second lever bar 272 to prevent accidental engagement of the engagement posts 284 with the spring posts 304.

Upon failure of the main spring 6, the main spring torque is reduced below the pulling force of the activation spring 211, which automatically pulls or rotates the activation bar 210. The activation bar 212 consequently pushes the plunger pin 228 into the plunger sleeve slot 224 allowing the plunger spring 230 to push the plunger 226 against the engagement disk 282. Simultaneously, the activation bar 212 moves the release member 212 that releases the stop 216 and allows the stop spring 217 to move the control shaft 218.

The force of the plunger 226 pushes the engagement disk 282 and thus pushes the engagement posts 284 toward an opened space between the spring posts 304. The free ends 286 of the engagement posts 284 will contact the spring post disk 308 and push it away, thus allowing the free ends 286 to engage with the notches 306 of the spring posts 304.

Movement of the control shaft 218 moves the control shaft block 250 which moves the control bar 252. The movement of the control bar 252 simultaneously moves the post 254 into the second section of the plate slots 246 allowing the control bar spring 260 to pivot the control bar 252 against the detents 264, and move the engagement block 256 out of engagement with the spring post 304.

With the engagement block 256 out of engagement with the spring post 304, and the engagement posts 284 engaged with the spring posts 304, the alternate embodiment backup spring system 200 is now in the engaged position. In the engaged position, the potential energy of the pre-wound auxiliary spring 12 is now transferred to the engagement posts 284 and thus to the pillow block 290, which transfers it to the shaft 5, thereby allowing the overhead door to operate until the main spring 6 is repaired or replaced.

While embodiments of the overhead door backup spring system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although providing an emergency spring counterweight for overhead doors upon failure of a main spring counterweight have been described, it should be appreciated that the overhead door backup spring system herein described is also suitable for any sliding element or closure which uses a spring for counter force or assisting force.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. An overhead door backup spring system comprising:

a spring associated with a shaft of an overhead door assembly;

an activation unit;

a control assembly having a moveable engagement block;

an auxiliary spring engagement assembly having at least one spring post extending from an auxiliary spring, said spring post being operably associated with said engagement block; and an engagement assembly operably associated with said activation unit and said auxiliary spring engagement assembly, said engagement assembly being slidably associated with said shaft, and said engagement assembly having at least one engagement post engageable with said spring post;

wherein said engagement post being in non-engagement with said spring post, and said engagement block being engaged with said spring post in a non-engaged position;

wherein said engagement post being engaged with said spring post, and said engagement block being in non-engagement with said spring post in an engaged position;

wherein said engagement assembly being configured to transfer torque from said auxiliary spring to said shaft in said engaged position.

2. The overhead door backup spring system according to claim 1, wherein said activation unit further comprising a plunger slidably associated with said shaft, and a plunger spring biasing said plunger toward said engagement assembly.

3. The overhead door backup spring system according to claim 2, wherein said activation unit further comprising a plunger sleeve surrounding said plunger and said plunger spring, said plunger sleeve defines a sleeve slot configured to slidably receive a plunger pin extending from said plunger and limit movement of said plunger.

4. The overhead door backup spring system according to claim 3, wherein said engagement assembly further comprising a pillow block attachable to said shaft, said pillow block defining at least one longitudinal bore therethrough, said longitudinal bore being configured to receive said engagement post.

5. The overhead door backup spring system according to claim 4, wherein said pillow block further comprising at least one biased member engageable with a recess defined in said engagement post when in said engaged position.

6. The overhead door backup spring system according to claim 4, wherein said engagement post further comprising a tapered free end featuring a ledge, and said spring post further comprising a notch configured to receive said ledge when said engagement post is in said engaged position.

7. The overhead door backup spring system according to claim 4, wherein said control assembly further comprising a moveable control bar, and a first plate defining a plate slot, said plate slot being configured to receive a post extending from said control bar and guide movement of said control bar, said engagement block being attachable to said control bar.

8. The overhead door backup spring system according to claim 7, wherein said sleeve slot and said plate slot each have a substantially J-shape or L-shape configuration.

9. The overhead door backup spring system according to claim 7, wherein said control assembly further comprising a second plate having at least one detent engageable with said control bar, and a control bar spring attachable to said control bar and said second plate.

10. The overhead door backup spring system according to claim 9, wherein said first plate is a pair of first plates in a spaced apart relationship configured to slidably receive said control bar therebetween, and said second plate is a pair of first plates in a spaced apart relationship configured to slidably receive said control bar therebetween.

11. The overhead door backup spring system according to claim 9, wherein said engagement block is located between said first and second plates.

12. The overhead door backup spring system according to claim 3, further comprising an activation bar coupled to said spring, said activation bar being operably associated with said plunger pin.

13. The overhead door backup spring system according to claim 12 further comprising an activation spring attached to said activation bar, said activation spring has a spring force less than a torque of said spring to move said activation bar upon failure of said spring.

14. The overhead door backup spring system according to claim 12 further comprising a linkage operably associated with said activation bar and a control bar of said control assembly, said linkage moves said control bar upon movement of said activation bar.

15. The overhead door backup spring system according to claim 2, wherein said engagement assembly further comprising an engagement disk slidably associated with said shaft and engageable with said plunger, said engagement post extending from said engagement disk parallel with said shaft.

16. The overhead door backup spring system according to claim 1, wherein said auxiliary spring engagement assembly further comprising an extension member extending from an end of said auxiliary spring, said spring post extending outwardly from said extension member.

17. The overhead door backup spring system according to claim 16, wherein said engagement post is a plurality of engagement posts encircling said shaft, and said spring post is a plurality of spring posts radially extending outwardly from said extension member.

18. A method of providing an auxiliary spring counterweight to an overhead door using an overhead door backup spring system, said method comprising the steps of:

a) coupling a spring with a shaft of said overhead door, said spring being configured to provide a counterweight force to said overhead door by way of said shaft;

b) coupling an activation unit and a control assembly to said spring;

c) sliding said activation unit and activating said control assembly from a non-engaged position to an engaged position upon failure of said spring;

d) moving an engagement block of said control assembly out of engagement with at least one spring post extending from an auxiliary spring;

e) moving an engagement assembly by said activation unit to engage at least one engagement post with said spring post; and f) transferring torque from said auxiliary spring to said shaft by way of said engagement assembly.

* * * * *